US009639010B2

(12) United States Patent
Hatano et al.

(10) Patent No.: US 9,639,010 B2
(45) Date of Patent: May 2, 2017

(54) ELECTROPHOTOGRAPHIC PHOTORECEPTOR, MANUFACTURING METHOD OF ELECTROPHOTOGRAPHIC PHOTORECEPTOR, IMAGE-FORMING APPARATUS AND IMAGE-FORMING METHOD

(71) Applicant: Konica Minolta, Inc., Tokyo (JP)

(72) Inventors: Hokuto Hatano, Hachioji (JP); Kazunori Kurimoto, Tokyo (JP); Seisuke Maeda, Fussa (JP); Hiroki Takao, Akishima (JP)

(73) Assignee: KONICA MINOLTA, INC., Tokyo (JP)

( * ) Notice: Subject to any disclaimer, the term of this patent is extended or adjusted under 35 U.S.C. 154(b) by 114 days.

(21) Appl. No.: 14/499,900

(22) Filed: Sep. 29, 2014

(65) Prior Publication Data

US 2015/0099217 A1 Apr. 9, 2015

(30) Foreign Application Priority Data

Oct. 4, 2013 (JP) ..... 2013-209063
Dec. 11, 2013 (JP) ..... 2013-255808

(51) Int. Cl.
*G03G 5/05* (2006.01)
*G03G 5/147* (2006.01)

(52) U.S. Cl.
CPC ..... *G03G 5/0575* (2013.01); *G03G 5/0507* (2013.01); *G03G 5/0542* (2013.01);
(Continued)

(58) Field of Classification Search
CPC ..... G03G 5/14769; G03G 5/14704; G03G 5/14734; G03G 5/0507; G03G 5/0546; G03G 5/0575
(Continued)

(56) References Cited

U.S. PATENT DOCUMENTS 5,399,452 A * 3/1995 Takegawa ..... G03G 5/05 430/56
7,416,823 B2 * 8/2008 Yanagawa ..... G03G 5/0532 399/159
(Continued)

FOREIGN PATENT DOCUMENTS

JP H 05-181299 7/1993
JP H 05-224453 9/1993
(Continued)

OTHER PUBLICATIONS

English language machine translation of JP 05-224453 (Sep. 1993).*
(Continued)

*Primary Examiner* — Christopher Rodee
(74) *Attorney, Agent, or Firm* — Lucas & Mercanti, LLP

(57) ABSTRACT

Disclosed is an electrophotographic photoreceptor including a conductive support, a photosensitive layer on the conductive support and a surface layer on the photosensitive layer. The surface layer includes a cured resin prepared by polymerization of a compound having two or more radically polymerizable functional groups per molecule, the cured resin containing an organic resin fine particle and a metal oxide fine particle, and the organic resin fine particle comprising a resin containing a structural unit derived from at least one of melamine and benzoguanamine, the organic resin fine particle having a number average primary particle size of 0.01 to 3.00 μm.

19 Claims, 7 Drawing Sheets

(52) U.S. Cl.
CPC ..... *G03G 5/0546* (2013.01); *G03G 5/0592* (2013.01); *G03G 5/14704* (2013.01); *G03G 5/14708* (2013.01); *G03G 5/14734* (2013.01); *G03G 5/14769* (2013.01); *G03G 5/14791* (2013.01)

(58) Field of Classification Search
USPC ..... 430/66
See application file for complete search history.

(56) References Cited

U.S. PATENT DOCUMENTS

| | | | | |
|---|---|---|---|---|
| 2005/0106482 | A1* | 5/2005 | Kami | G03G 5/0217 430/57.2 |
| 2005/0266328 | A1* | 12/2005 | Yanagawa | G03G 5/0542 430/66 |
| 2008/0026308 | A1* | 1/2008 | Qi | G03G 5/0567 430/58.4 |
| 2010/0129115 | A1* | 5/2010 | Ishida | G03G 5/14704 399/159 |

FOREIGN PATENT DOCUMENTS

| | | | |
|---|---|---|---|
| JP | 2003-149995 | A | 5/2003 |
| JP | 2007-094240 | A | 4/2007 |

OTHER PUBLICATIONS

English language machine translation of JP 05-181299 (Jul. 1993).*

* cited by examiner

ELECTROPHOTOGRAPHIC PHOTORECEPTOR, MANUFACTURING METHOD OF ELECTROPHOTOGRAPHIC PHOTORECEPTOR, IMAGE-FORMING APPARATUS AND IMAGE-FORMING METHOD

BACKGROUND OF THE INVENTION

1. Field of the Invention

The present invention relates to an electrophotographic photoreceptor to be installed in an electrophotographic image-forming apparatus, a manufacturing method of the electrophotographic photoreceptor, an image-forming apparatus including the electrophotographic photoreceptor, and a method of forming an image with the electrophotographic photoreceptor.

2. Description of Related Art

A typical conventional electrophotographic image-forming apparatus includes an electrophotographic photoreceptor (hereinafter also referred to merely as "photoreceptor"), such as an inorganic photoreceptor or an organic photoreceptor. In a typical "electrophotographic" process, the photoconductive photoreceptor is charged in a dark state by a means such as corona discharge and then is exposed to selectively dissipate only the charges on the exposed portions and to produce an electrostatic latent image, and then the latent image is developed into a visualized image with a toner composed of a resin and a colorant, such as a dye or pigment.

The organic photoreceptor is advantageous compared to the inorganic photoreceptor because it has high selectivity on a sensitive wavelength range, high film formation properties, high flexibility and transparency of the resulting film, high productivity suitable for mass production, low toxicity, and low material and manufacturing costs. Most of the current photoreceptors are accordingly organic photoreceptors.

A recent organic photoreceptor is provided with a surface layer composed of a cross-linked cured resin on one surface. This configuration can improve the wear resistance, scratch resistance, and environmental stability, leading to a prolonged service life.

The surface layer has a relatively smooth surface. In other words, the roughness of the surface layer is lower and less readily roughened compared to that of a photoreceptor including no surface layer composed of a cross-linked cured resin. Unfortunately, such a smooth surface has a larger contact area with a cleaning blade and generates increased torque, resulting in vigorous stick-slip vibrations. The photoreceptor is therefore not sufficiently cleaned. In order to solve this problem, for example, JP 2003-149995 and JP 2007-94240 disclose the application of a lubricant onto the photoreceptor surface to reduce the adhesion of the photoreceptor to the toner and the cleaning blade.

For example, a developer containing a lubricant is applied to the photoreceptor surface by developing biasing in a developing step in JP 2007-94240. Unfortunately, the photoreceptor surface sometimes does not receive a sufficient amount of lubricant. This configuration cannot sufficiently reduce the adhesion, so that the photoreceptor is not sufficiently cleaned. If the photoreceptor is charged with a roller discharging mechanism in a charging step, the photoreceptor surface readily catches corona products generated during the discharge. This configuration also cannot sufficiently reduce the adhesion, so that the photoreceptor is not sufficiently cleaned. Although the application of an increased amount of lubricant can improve the cleaning operation, the lubricant is often unevenly distributed because of nonuniform printing rates in an image, resulting in the uneven densities in the image between lubricant-rich portions and lubricant-poor portions.

In another known technique, metal oxide fine particles are added to the surface layer of the photoreceptor to improve the durability of the photoreceptor. In particular, metal oxide fine particles having low resistance and a relatively large diameter (in specific, 100 nm or larger) can achieve both the high durability and the stable potential.

In another known technique, an organic filler is added to the surface layer of the photoreceptor to improve the cleaning operation. The added organic filler can appropriately roughen the photoreceptor surface, leading to an improvement in the cleaning operation.

JP H5-224453 discloses the addition of a benzoguanamine-melamine-formaldehyde condensate to the surface layer of the photoreceptor. JP H5-181299 discloses the addition of benzoguanamine resin fine particles and/or melamine resin fine particles to the surface layer of the photoreceptor.

The organic filler such as the benzoguanamine-melamine-formaldehyde condensate has low adhesion to the toner and thus can significantly improve the cleaning operation. Unfortunately, if such an organic filler is used with metal oxide fine particles, coagulation occurs in a coating solution for preparation of a surface layer. In particular, the combination of the organic filler with metal oxide fine particles having a large diameter often causes coagulation. The coagulations in the coating solution will remain in the resulting photoreceptor, which cannot provide the expected effects. The coagulations in the surface layer lead to abnormal wear of the cleaning blade, thereby significantly impairing the cleaning operation.

SUMMARY OF THE INVENTION

An object of the invention, which has been accomplished to solve the above problems, is to provide an electrophotographic photoreceptor, an image-forming apparatus, and an image-forming method that can achieve an excellent cleaning operation while preventing the uneven density of a formed image. Another object of the invention is to provide a highly durable electrophotographic photoreceptor that can be sufficiently cleaned and a method of producing the electrophotographic photoreceptor. Another object of the invention is to provide an image-forming apparatus that can form high-quality images for a long period.

According to a first aspect of the preferred embodiments of the present invention, there is provided an electrophotographic photoreceptor including a conductive support, a photosensitive layer on the conductive support and a surface layer on the photosensitive layer, and the surface layer comprises a cured resin prepared by polymerization of a compound having two or more radically polymerizable functional groups per molecule, the cured resin containing an organic resin fine particle and a metal oxide fine particle, and the organic resin fine particle comprising a resin containing a structural unit derived from at least one of melamine and benzoguanamine, the organic resin fine particle having a number average primary particle size of 0.01 to 3.00 μm.

Preferably, the organic resin fine particle comprises a polycondensate of melamine and formaldehyde.

Preferably, the organic resin fine particle is contained in an amount of 5 to 40 parts by mass relative to 100 parts by mass of the cured resin.

Preferably, the metal oxide fine particle is surface-treated with a surface treating agent comprising a compound having a radically polymerizable functional group.

Preferably, the cured resin comprises an acrylic resin.

Preferably, the surface layer comprises a charge transportable compound.

According to a second aspect of the preferred embodiments of the present invention, there is provided an image-forming apparatus including an electrophotographic photoreceptor, a charging unit to charge the surface of the electrophotographic photoreceptor, an exposing unit to form an electrostatic latent image on the surface of the electrophotographic photoreceptor, a developing unit to develop the electrostatic latent image with a developer comprising a toner to form a toner image, a transferring unit to transfer the toner image onto a transfer medium, a fixing unit to fix the transferred toner image on the transfer medium, a cleaning unit to remove residual toner on the electrophotographic photoreceptor and a lubricant applying mechanism to apply a lubricant on the surface of the electrophotographic photoreceptor, and the electrophotographic photoreceptor is the above electrophotographic photoreceptor.

Preferably, the charging unit is of a contact or contactless roller discharging mechanism.

According to a third aspect of the preferred embodiments of the present invention, there is provided a method of forming an image including charging a surface of the electrophotographic photoreceptor, exposing to form an electrostatic latent image on the surface of the electrophotographic photoreceptor, developing the electrostatic latent image with a developer comprising a toner to forma toner image, transferring the toner image on a transfer medium, fixing the transferred toner image on the transfer medium and cleaning to remove a residual toner on the electrophotographic photoreceptor, and the developer further comprises a lubricant, and the electrophotographic photoreceptor is the above electrophotographic photoreceptor.

Preferably, in the charging, the electrophotographic photoreceptor is charged by a contact or contactless roller discharging mechanism.

According to a fourth aspect of the preferred embodiments of the present invention, there is provided an electrophotographic photoreceptor including a conductive support, a photosensitive layer on the conductive support and a surface layer on the photosensitive layer, and the surface layer comprises a cured resin prepared by polymerization of a compound having two or more radically polymerizable functional groups per molecule, the cured resin containing an inorganic fine particle and an organic resin fine particle, at least part of the surface of the inorganic fine particle comprising a metal oxide and the organic resin fine particle comprising a resin containing a structural unit derived from at least one of melamine and benzoguanamine, and the organic resin particle is surface-treated with a coupling agent.

Preferably, the organic resin fine particle has a number average primary particle size of 100 nm to 1500 nm.

Preferably, the coupling agent contains a fluorine atom.

Preferably, the inorganic fine particle has a number average primary particle size of 10 nm to 300 nm.

Preferably, the inorganic fine particle comprises at least one of tin oxide and titanium oxide.

Preferably, the inorganic fine particle is a composite fine particle comprising a core and a metal oxide sheath.

Preferably, the core comprises at least one of aluminum oxide, barium sulfate, and silicon oxide.

Preferably, the sheath comprises at least one of tin oxide and titanium oxide.

Preferably, the radically polymerizable functional group is an acryloyl group or methacryloyl group.

According to a fifth aspect of the preferred embodiments of the present invention, there is provided a method of manufacturing an electrophotographic photoreceptor including a conductive support, a photosensitive layer on the conductive support, and a surface layer on the photosensitive layer, the method including applying a compound having two or more radically polymerizable functional groups per molecule, an inorganic fine particle, at least part of a surface of the inorganic fine particle comprising a metal oxide, and an organic resin fine particle comprising a resin containing a structural unit derived from at least one of melamine and benzoguanamine onto a photosensitive layer to form a coating film, and curing the coating film.

According to a sixth aspect of the preferred embodiments of the present invention, there is provided an image-forming apparatus including an electrophotographic photoreceptor, a charging unit which charges a surface of the electrophotographic photoreceptor, an exposing unit which forms an electrostatic latent image on the surface of the electrophotographic photoreceptor, a developing unit which develops the electrostatic latent image with a developer comprising a toner to form a toner image, a transferring unit which transfers the toner image onto a transfer medium, a fixing unit which fixes the transferred toner image on the transfer medium and a cleaning unit which removes residual toner on the electrophotographic photoreceptor, and the cleaning unit comprises a blade, and the electrophotographic photoreceptor is the electrophotographic photoreceptor according to claim 11.

BRIEF DESCRIPTION OF THE DRAWINGS

The above and other objects, advantages and features of the present invention will become more fully understood from the detailed description given hereinbelow and the appended drawings which are given byway of illustration only, and thus are not intended as a definition of the limits of the present invention, and wherein.

DESCRIPTION OF THE PREFERRED EMBODIMENTS

The invention will now be described in detail.

[Electrophotographic Photoreceptor]

A photoreceptor according to the invention may be any photoreceptor that includes a photosensitive layer and a surface layer deposited on a conductive support in this sequence. For example, the photoreceptor may have the following layer configuration (1) or (2):

(1) an intermediate layer, a photosensitive layer including a charge generating sublayer and a charge transportable sublayer, and a surface layer are layered (deposited) on a conductive support in this sequence; or (2) an intermediate layer, a single photosensitive layer containing a charge generating compound and a charge transportable compound, and a surface layer are layered (deposited) on a conductive support in this sequence.

Figure 1:
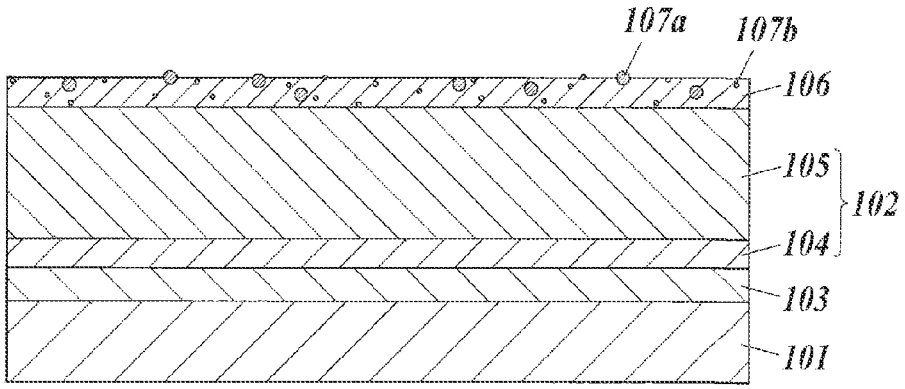
FIG. 1 is a cross-sectional view illustrating an exemplary layer configuration of a photoreceptor according to the invention.

FIG. 1 is a cross-sectional view illustrating an exemplary layer configuration, in specific, the layer configuration (1) of the photoreceptor according to the invention. In the photoreceptor, a photosensitive layer 102 is layered (deposited) via an intermediate layer 103 on a conductive support 101, and a surface layer 106 is layered (deposited) on the photosensitive layer 102. The photosensitive layer 102 includes a charge generating sublayer 104 layered (deposited) on the intermediate layer 103 and a charge transportable sublayer 105 deposited on the charge generating sublayer 104. The surface layer 106 contains organic resin fine particles 107*a* and metal oxide fine particles (or inorganic fine particles) 107*b*.

The photoreceptor according to the invention is an organic photoreceptor. In general, the organic photoreceptor indicates an electrophotographic photoreceptor in which an organic compound achieves at least one of a charge generating function and a charge transporting function, which functions are essential for the electrophotographic photoreceptor. Examples of the organic photoreceptor include a photoreceptor containing a known organic charge generating compound or organic charge transportable compound, and a photoreceptor containing a polymer complex having a charge generating function and a charge transporting function.

The photoreceptor according to the invention is negatively chargeable. The surface of the photoreceptor is negatively charged and exposed, and then the charge generating sublayer (or the single photosensitive layer) generates charges. The generated negative charges (electrons) travel to the conductive support via the intermediate layer, whereas the positive charges (holes) travel to the surface of the organic photoreceptor via the charge transportable sublayer (or the single photosensitive layer) and cancel the negative charges on the surface. This process produces an electrostatic latent image.

[Surface Layer]

The surface layer of a photoreceptor according to a first aspect of the present invention is composed of a cured resin prepared by polymerization of a compound having two or more radically polymerizable functional groups per molecule. The cured resin contains organic resin fine particles and metal oxide fine particles. The organic resin fine particles are composed of a resin containing a structural unit derived from at least one of melamine and benzoguanamine, and has a number average primary particle size of 0.01 to 3.00 μm.

The surface layer of a photoreceptor according to a second aspect of the present invention is composed of a cured resin prepared by polymerization of a compound having two or more radically polymerizable functional groups per molecule. The cured resin contains inorganic fine particles and organic resin fine particles. At least part of the surface of the inorganic fine particle is composed of a metal oxide. The organic resin fine particle is composed of a resin containing a structural unit derived from at least one of melamine and benzoguanamine. The organic resin particle is surface-treated with a coupling agent.

At least part of the surface of the inorganic fine particle is composed of a metal oxide. The surface of the inorganic fine particle may be composed of only the metal oxide fine particle or the combination of the metal oxide fine particle and other materials.

The photoreceptor of the present invention, having the surface layer composed of a cured resin, essentially has high film strength. The inorganic fine particles in the cured resin enforce the film strength. The photoreceptor thus has high durability. Furthermore, since the organic resin fine particles in the cured resin are surface-treated with a coupling agent, the agglomeration of the organic resin fine particles and the inorganic fine particles is prevented in a coating solution for a surface layer prepared in a process of manufacturing the photoreceptor. This reduces the agglomeration of the organic resin fine particles and the inorganic fine particles in a surface layer formed by applying the coating solution on the photosensitive layer and curing the coating solution. The organic resin fine particle thus can effectively provide its advantageous characteristics. The photoreceptor of the present invention described above can perform sufficient cleaning operations and has high durability.

Although the inorganic fine particle may also be surface-treated with a coupling agent to prevent the agglomeration of the organic resin fine particles and the inorganic fine particles, the surface-treated inorganic fine particle may decrease electrical characteristics of the photoreceptor. The photoreceptor of the present invention, composed of the organic resin fine particles surface-treated with a coupling agent, can reduce the agglomeration in the surface layer, while maintaining the functionality of a photoreceptor.

(Cured Resin)

The surface layer is primarily composed of a cured resin. The cured resin is prepared by polymerization of a compound having two or more radically polymerizable functional groups (hereinafter also referred to as a "polyfunctional radically polymerizable compound"). In specific, the cured resin is formed by polymerizing and curing the polyfunctional radically polymerizable compound by ultraviolet beams or electron beams.

Although the cured resin is composed of the polyfunctional radically polymerizable compound as a monomer for forming the cured resin, a compound having one radically polymerizable functional group (hereinafter also referred to as a "monofunctional radically polymerizable compound") may be used in combination. In this case, the rate of the monofunctional radically polymerizable compound is preferably 0 to 30 mass % relative to the total amount of the monomers to form the cured resin.

Examples of the radically polymerizable functional group include vinyl groups, acryloyl groups, and methacryloyl groups.

A particularly preferred polyfunctional radically polymerizable compound is an acrylic monomer or an acrylic oligomer having two or more acryloyl groups ($CH_2{=}CHCO{-}$) or methacryloyl groups ($CH_2{=}CCH_3CO{-}$) as radically polymerizable functional groups, which can be cured at low-light intensity within a short time. A preferred cured resin is thus an acrylic resin composed of an acrylic monomer or acrylic oligomer.

In the present invention, the polyfunctional radically polymerizable compound may be used alone or in combination with other compounds. In addition, the polyfunctional radically polymerizable compound may be used as a monomer and may be used as an oligomer.

Specific examples of the polyfunctional radically polymerizable compound will now be described.

[Chemical formula 1]

M1

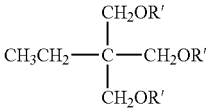

M2

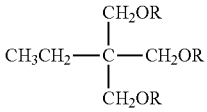

M3

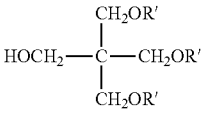

M4

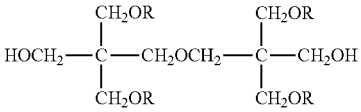

M5

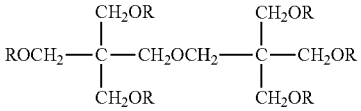

M6

$CH_3CH_2C{-}(CH_2OC_3H_6OR)_3$

M7

$CH_3CH_2C{-}(CH_2CH_2OR)_3$

[Chemical formula 2]

M8

$R{-}(OC_3H_6)_3{-}OR$

M9

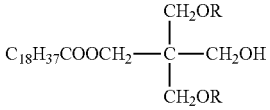

M10

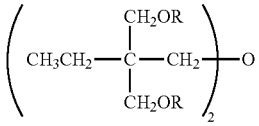

M11

$(ROCH_2)_4{-}C$

-continued

M12

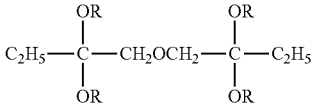

M13

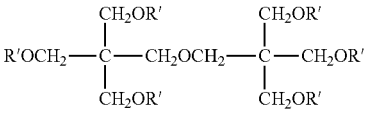

M14

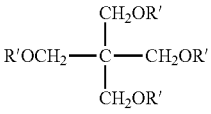

In the chemical formulae representing the exemplary chemical compounds (M1) to (M14), R is an acryloyl group ($CH_2{=}CHCO{-}$), and R' is a methacryloyl group ($CH_2{=}CCH_2CO{-}$).

(Organic Resin Fine Particle)

Organic resin fine particles are composed of a resin containing a structural unit derived from at least one of melamine and benzoguanamine (hereinafter also referred to as "untreated organic resin fine particles"). Specific examples of the organic resin fine particle include polycondensates of melamine and formaldehyde; melamine resins, such as polycondensates of melamine, benzoguanamine and formaldehyde; and benzoguanamine resins, such as polycondensates of benzoguanamine and formaldehyde.

For sufficient toner cleaning and uniform image density, the organic resin fine particles are preferably polycondensates of melamine and formaldehyde.

Since the surface layer contains the organic resin fine particles, the surface of the photoreceptor can be appropriately roughened to perform sufficient cleaning operations. The organic resin fine particles have low van der Waals' force, which can reduce adhesion to the toner, leading to improved cleaning operations.

The organic resin fine particle has a number average primary particle size of 0.01 to 3.00 μm, preferably 0.1 to 1.5 μm, more preferably 0.2 to 1.0 μm.

The photoreceptor, which contains the organic resin fine particles each having a number average primary particle size within the above-mentioned rage, can have an appropriately roughened surface providing sufficient cleaning operations.

In the present invention, the number average primary particle size of the organic resin fine particle is measured as follows.

A sample for the measurement is prepared by cutting a photosensitive layer including a surface layer with a knife, and bonding the cut photosensitive layer to a holder such that the cut surface is in the upward direction.

The photographic image of the sample for the measurement is observed and captured with a scanning electron microscope to determine the number average primary particle size. The photographic image is captured with a microscope at a magnification of 30,000 fold to randomly select 100 fine particles to be observed from the photographic image. In specific, the photographic image is binarized by an automatic image processing analyzer "LUZEX AP" (available from Nireco Corporation) to determine the horizontal Feret's diameters of 100 fine particles and the average value thereof, which corresponds to the number average primary particle size.

According to the photoreceptor of the present invention, the surface layer including such organic resin fine particles can be appropriately roughened for sufficient cleaning operations. In addition, a negatively charged toner, lubricant (for example, zinc stearate), and positively-charged melamine and benzoguanamine resins are ranked according to electrification in this order; therefore, even with uneven supply of the lubricant, the contact electrical charge is dominant between the surface of the photoreceptor including organic resin fine particles and the negatively charged toner to that between the negatively charged toner and the lubricant. This prevents fluctuation of the electrical potential caused by the contact electrical charge between the toner and the lubricant and irregular density of images to be formed.

The organic resin fine particles should preferably be contained in an amount of 5 to 50 parts by mass, more preferably 5 to 40 parts by mass, particularly preferably 10 to 30 parts by mass, relative to 100 parts by mass of the cured resin.

The organic resin fine particles contained in an amount within the range are exposed on the surface of the photoreceptor in correlation with the number average primary particle size; therefore, even with uneven supply of the lubricant, the contact electrical charge between the surface of the photoreceptor including the organic resin fine particles and the negatively charged toner becomes dominant. This effectively prevents irregular image density caused by the uneven supply of the lubricant.

An excess amount of organic resin fine particles contained in the surface of the photoreceptor may lead to low light transmission, resulting in the formation of an undesired latent image. In contrast, a significantly low amount of organic resin fine particles contained in the surface region of the photoreceptor may lead to insufficient roughness of the surface, resulting in poor cleaning operations and irregular image density caused by the uneven lubricant adhering to the surface of the photoreceptor.

Examples of the organic resin fine particles include melamine resins (polycondensates of melamine and formaldehyde), such as "Epostar S" and "Epostar S6", and benzoguanamine resins (polycondensates of benzoguanamine and formaldehyde), such as "Epostar MS" (which are all commercially available from Nippon Shokubai Co., Ltd.).

The organic resin fine particles may be fine particles of a resin containing a structural unit derived from at least one of melamine and benzoguanamine, the fine particles (the above mentioned untreated organic resin fine particles) being surface-treated with a coupling agent.

The organic resin fine particle surface-treated with the coupling agent has a modified surface which can prevent the agglomeration of the organic resin fine particles and the inorganic fine particles in a coating solution for forming a surface layer prepared in a process of manufacturing the photoreceptor described below.

Examples of the coupling agent include a silane coupling agent.

The silane coupling agent has two or more methoxy or ethoxy groups and has a molecular weight ranging generally from 100 to 1500, preferably from 200 to 1000.

The coupling agent should preferably be a fluorine-containing agent. In specific, the coupling agent should preferably have one to ten $CF_2$ groups, more preferably two to eight $CF_2$ groups.

The fluorine-containing coupling agent can further reduce the adhesion of the organic resin fine particles to the toner. A possible cause for the phenomenon may be the function of the fluorine-containing coupling agent which neutralizes the positive charge of the organic resin fine particles.

Specific examples of the coupling agent will now be described.

C-1: $CF_3CF_2CF_2CF_2CF_2CF_2CF_2CF_2CH_2CH_2Si(OCH_2CH_3)_3$

C-2: $CF_3CF_2CF_2CF_2CF_2CF_2CF_2CF_2CH_2CH_2Si(OCH_3)_3$

C-3: $CF_3CF_2CF_2CF_2CF_2CF_2CH_2CH_2Si(OCH_2CH_3)_3$

C-4: $CF_3CF_2CF_2CF_2CF_2CF_2CH_2CH_2Si(OCH_3)_3$

C-5: $CF_3CF_2CF_2CF_2CF_2CH_2CH_2Si(OCH_2CH_3)_3$

C-6: $CF_3CF_2CF_2CF_2CH_2CH_2Si(OCH_3)_3$

C-7: $CF_3CH_2CH_2Si(OCH_3)_3$

C-8: $CH_2{=}C(CH_3)COO(CH_2)_3Si(OCH_3)_3$

[Chemical formula 3]

C-9

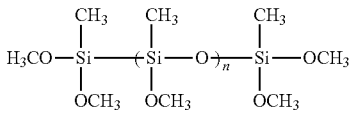

n = 10 ~ 50

The coupling agent may be used alone or in combination.

The coupling agent should preferably be treated in an amount of 5 to 90 mass %, more preferably 10 to 70 mass % relative to untreated organic resin fine particles.

Non-limiting examples of the surface treatment with the coupling agent include wet processes. In specific, a typical wet process for the surface treatment involves stirring the dispersion of untreated organic resin fine particles and the coupling agent in a solvent at a predetermined temperature, and removing the solvent into resin powder. The temperature for the treatment is 20 to 60° C., for example, and the stirring time is 30 to 60 minutes, for example. Acids, such as hydrochloric acid and sulfuric acid may be added as catalysts. The resultant powder may be dried at a temperature of 80 to 150° C. for 30 to 90 minutes.

In the present invention, the coupling agent applied to the surfaces of the organic resin fine particles can be determined by the evaluation of functional groups by infrared (IR) absorption analysis and a weight reduction calculated by thermogravimetric (TG) analysis.

(Metal Oxide Fine Particles)

Non-limiting examples of the metal oxide fine particles include particles of silica (silicon oxide), magnesium oxide, zinc oxide, lead oxide, alumina (aluminum oxide), zirconium oxide, tin oxide, titania (titanium oxide), niobium oxide, molybdenum oxide, and vanadium oxide. Particularly preferred are tin oxide particles for their hardness, conductivity, and light transmission.

The metal oxide fine particle should preferably has a number average primary particle size in the range of 1 to 300 nm, more preferably 3 to 100 nm, further preferably 5 to 40 nm.

In the present invention, the number average primary particle size of the metal oxide fine particles is measured as follows.

A sample for the measurement is prepared by cutting a photosensitive layer including a surface layer with a knife, and bonding the cut photosensitive layer to a holder such that the cut surface is in the upward direction. The photographic image of the sample for the measurement is captured with a scanning electron microscope (available from JEOL Ltd.) at a magnification of 10,000 fold. The photographic images including randomly-selected 300 particles (other than agglomerated particles) from a scanner are processed with an automatic image processing analyzer "LUZEX AP (Software Ver. 1.32)" (available from Nireco Corporation) to determine the number average primary particle size.

The metal oxide fine particle should preferably be surface-treated with a surface treating agent containing a compound having radically polymerizable functional groups.

In specific, the metal oxide fine particle should preferably be surface-treated with the surface treating agent containing the compound having radically polymerizable functional groups such that the radically polymerizable functional groups are introduced onto the surfaces of the metal oxide fine particles.

The metal oxide fine particle surface-treated with the surface treating agent containing a compound having radically polymerizable functional groups can be reacted with a radically polymerizable compound to form a cross-linked structure at the step of forming a surface layer in the manufacturing process of the photoreceptor described below, resulting in a formation of a surface layer having sufficient film strength. In addition, the metal oxide fine particle has high dispersibility in a cured resin.

Examples of the radically polymerizable functional group in the surface treating agent include vinyl groups, acryloyl groups, and methacryloyl groups. Such a radically polymerizable functional group can be reacted with a radically polymerizable compound forming a cured resin to form a surface layer having high film strength. Preferred examples of the surface treating agent having radically polymerizable functional groups include a silane coupling agent having polymerizable functional groups, such as a vinyl group, acryloyl group, and methacryloyl group.

Specific examples of the surface treating agent containing the compound having radically polymerizable functional groups will now be described.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)_2(OCH_3)$
S-32: $CH_2{=}CHCOO(CH_2)_2Si(CH_3)(OCOCH_3)_2$
S-33: $CH_2{=}CHCOO(CH_2)_2Si(CH_3)(ONHCH_3)_2$
S-34: $CH_2{=}CHCOO(CH_2)_2Si(CH_3)(OC_6H_5)_2$
S-35: $CH_2{=}CHCOO(CH_2)_2Si(C_{10}H_{21})(OCH_3)_2$
S-36: $CH_2{=}CHCOO(CH_2)_2Si(CH_2C_6H_5)(OCH_3)_2$

Alternatively, any surface treating agents other than the example compounds (S-1) to (S-36) may be used. A silane compound having radically polymerizable reactive organic groups may also be used.

The surface treating agents may be used alone or in combination.

The surface treating agent should preferably be treated in an amount of 0.1 to 200 parts by mass, more preferably 7 to 70 parts by mass, relative to 100 parts by mass of untreated metal oxide particle.

The surfaces of the untreated metal oxide fine particles are treated, for example, with the surface treating agent by wet disintegration of the slurry (suspension of solid particles) containing the untreated metal oxide fine particles and the surface treating agent. Such a method prevents reaggregation of the metal oxide fine particles, while executing the surface-treatment of the metal oxide fine particles. The solvent is then removed and the residue is powdered.

Examples of the surface-treatment device include wet-media dispersers. The wet-media disperser has a container loaded with media beads and a stirring disk mounted vertically to a rotary shaft. The stirring disk rapidly spins to mill and disperse aggregated metal oxide fine particles. Any type of the disperser can be used which can sufficiently disperse the metal oxide fine particles during the surface-treatment of the metal oxide fine particles. Various types of the disperser may be used, such as a vertical type, horizontal type, flow type, and batch type. Specific examples of the disperser include sand mills, ultravisco mills, pearl mills, glen mills, dyno mills, agitator mills, dynamic mills. These dispersers pulverize and disperse the particle by impact cracking, friction, shear force, or shear stress provided by grinding media, such as balls and beads.

The beads used in the wet-media disperser may be spheres composed of glass, alumina, zircon, zirconia, steel, or flint; particularly preferred are zirconia or zircon-based beads. Although the diameter of the bead is usually about 1 to 2 mm, a preferred dimension is about 0.1 to 1.0 mm in the present invention.

The disk and the inner wall of the container of the wet-media disperser may be composed of any material, such as stainless steel, nylon, and ceramic. Specifically, in the present invention, the disk and the inner wall of the container should preferably be composed of ceramics, such as zirconia and silicon carbide.

The metal oxide fine particle should preferably be contained in an amount of 60 to 100 parts by mass, more preferably 70 to 90 parts by mass, relative to 100 parts by mass of the cured resin.

The metal oxide fine particles contained in an amount within the range can provide sufficient hardness, conductivity, and light transmission.

An excess amount of metal oxide fine particles may provide poor light-transmission, which adversely affects the formation of the latent image, and lead to defects on the image caused by the agglomeration. In contrast, a significantly low amount of metal oxide fine particles may decrease the hardness, which leads to poor abrasion resistance, and reduce the sensitivity, which leads to irregular density of images formed by rapid printing processes.

In the above description, the metal oxide fine particles are composed of a single substance. Alternatively, the metal oxide fine particles may be composed of inorganic fine particles at least parts of the surfaces of which are metal oxide. The metal oxide fine particles may be composed of a single substance or a combination of different substances.

(Inorganic Fine Particle)

The inorganic fine particles have surfaces at least parts of which are metal oxide, and may be composed of a single substance or may be composed of a combination of different substances. Specific examples of the inorganic fine particle composed of different substances include composite fine particles having a core-shell structure having a core coated with metal oxide. The cores of the composite fine particles having the core-shell structure may have surfaces partially exposed, or may have surfaces completely covered with coating material.

Examples of the inorganic fine particle composed of a single substance include particles of silicon oxide (silica), magnesium oxide, zinc oxide, lead oxide, aluminum oxide (alumina), zirconium oxide, tin oxide, titanium oxide (titania), niobium oxide, molybdenum oxide, and vanadium oxide. Particularly preferred are tin oxide particles and titanium oxide particles for their hardness, conductivity, and light-transmission.

For the inorganic fine particle which is a composite fine particle having a core-shell structure, the core is made of insulating material, such as barium sulfate, silicon oxide, and aluminum oxide. The core should preferably be made of barium sulfate for its light-transmission. Examples of the metal oxide used in form of a sheath include tin oxide, titanium oxide, zinc oxide, zirconia, and indium tin oxide.

The amount of metal oxide attached to the core should preferably be 30 to 80 mass %, more preferably 40 to 70 mass %, relative to the core.

The metal oxide sheath can be attached to the core by any method, for example, as is disclosed in JP 2009-255042, for example.

As described above, the organic fine particle which is a composite fine particle having a core-shell structure can have a large particle size, while maintaining conductivity and light-transmission, thus leading to stable electric properties and high film strength.

The volume resistivity of the inorganic fine particle should preferably be $10^{-3}$ to $10^{7}$ [Ωcm], more preferably $10^{-1}$ to $10^{5}$ [Ωcm].

The volume resistivity is measured by a digital ultrahigh resistance/micro current meter TR8611A (available from Takeda Riken Industry Co., Ltd) in an environment at a temperature of 23° C. and a humidity of 50%.

The inorganic fine particle should preferably have a number average primary particle size of 10 to 300 nm, more preferably 20 to 250 nm.

The inorganic fine particle having a particle size within the range can provide sufficiently high film strength.

In the present invention, the number average primary particle size of the inorganic fine particle is measured as follows.

A sample for the measurement is prepared by cutting a photosensitive layer including a surface layer with a knife and bonding the cut photosensitive layer to a holder such that the cut surface is in the upward direction. The photographic image of the sample for the measurement is captured with a scanning electron microscope (available from JEOL Ltd.) at a magnification of 10,000 fold. The photographic images including randomly-selected 300 particles (other than agglomerated particles) from a scanner are processed with an automatic image processing analyzer "LUZEX AP (Software Ver. 1.32)" (available from Nireco Corporation) to determine the number average primary particle size.

The organic fine particles should preferably be contained in an amount of 50 to 200 parts by mass, more preferably 70 to 150 parts by mass, relative to 100 parts by mass of the cured resin.

The organic fine particle contained in an amount within the range can provide sufficient hardness, conductivity, and light transmission.

(Charge Transportable Compound)

The surface layer should preferably contain a charge transportable compound.

Any charge transportable compound may be used which can transport charge carriers in a surface layer. Particularly preferred is a compound represented by Formula 1 described below.

The photoreceptor of the present invention which contains the charge transportable compound in the surface layer can provide sufficient responsiveness even during high-speed printing operations.

The charge transportable compound used in the present invention is not reacted with a surface treating agent containing a polyfunctional radically polymerizable compound and a compound having radically polymerizable functional groups.

[Chemical formula 4]

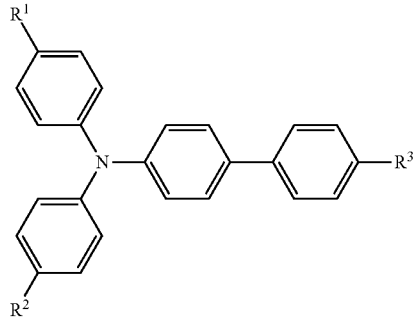

In Formula 1, $R^1$ and $R^2$ each independently represent a hydrogen atom or methyl group. $R^3$ represents a linear or branched alkyl group having one to five carbon atoms, and should preferably be a propyl group, pentyl group, or butyl group.

Specific examples of the compound represented by Formula 1 will now be described.

| Compound | Structure | Molecular weight |
|---|---|---|
| | [Chemical formula 5] | |
| CTM-1 | 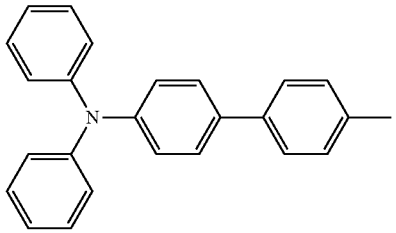 | 321.43 |

-continued
| Compound | Structure | Molecular weight |
|---|---|---|
| CTM-2 | 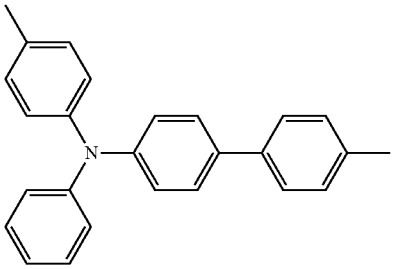 | 349.48 |
| CTM-3 | 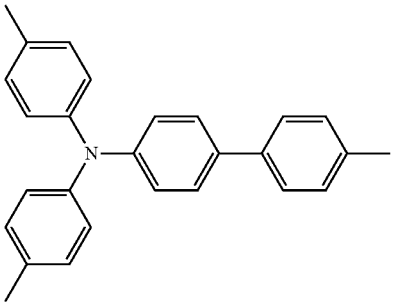 | 363.51 |
| CTM-4 | 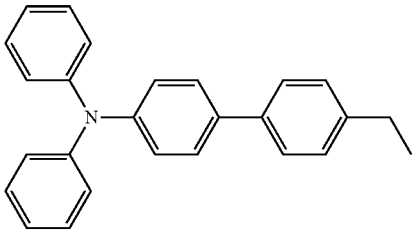 | 349.48 |
| CTM-5 | 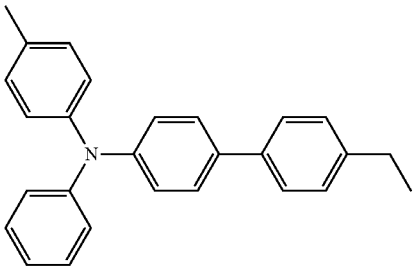 | 363.51 |
[Chemical formula 6]
| | | |
|---|---|---|
| CTM-6 | 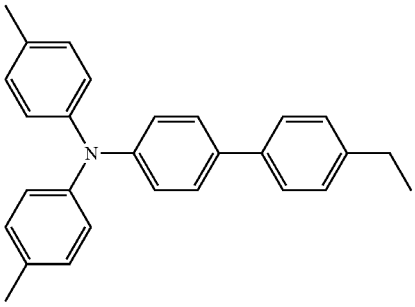 | 377.53 |

-continued
| Compound | Structure | Molecular weight |
|---|---|---|
| CTM-7 | 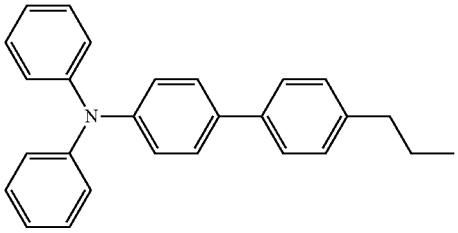 | 363.51 |
| CTM-8 | 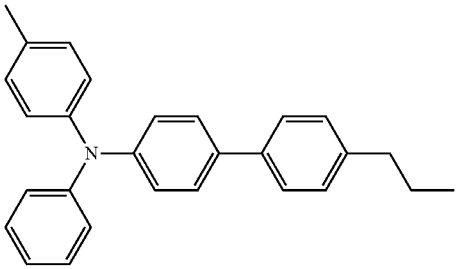 | 377.53 |
| CTM-9 | 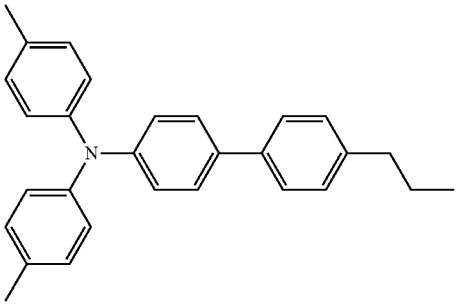 | 391.56 |
| CTM-10 | 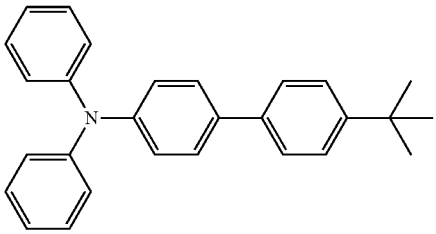 | 377.53 |
[Chemical formula 7]
| | | |
|---|---|---|
| CTM-11 | 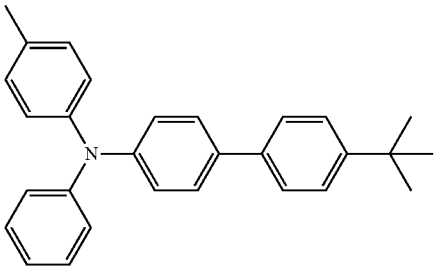 | 391.56 |

-continued

| Compound | Structure | Molecular weight |
|---|---|---|
| CTM-12 | 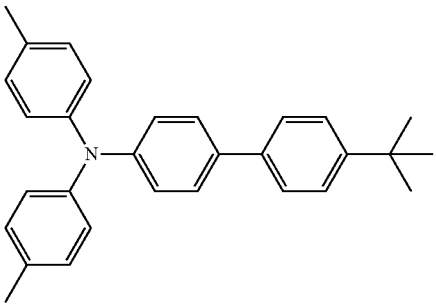 | 405.59 |
| CTM-13 | 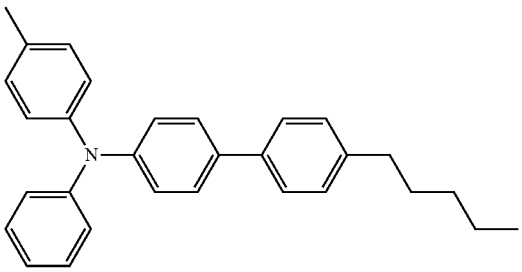 | 405.59 |
| CTM-14 | 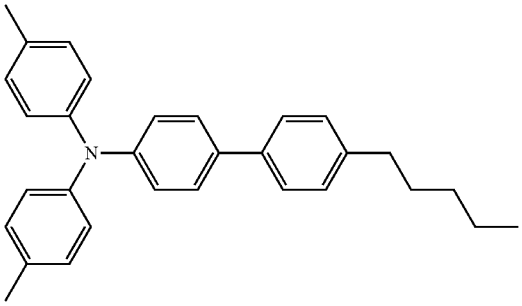 | 419.62 |
| CTM-15 | 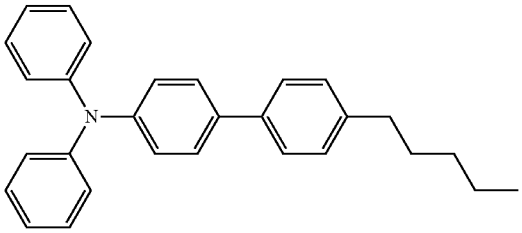 | 391.56 |

The compound represented by Formula 1 can be synthesized by any known method, for example, as is disclosed in JP 2006-143720.

The charge transportable compound should preferably be contained in an amount of 10 to 30 parts by mass, more preferably 15 to 25 parts by mass, relative to 100 parts by mass of the cured resin.

The charge transportable compound contained in an amount within the range can provide sufficient responsiveness even during high-speed printing operations.

An excess amount of charge transportable compound decreases the film strength of the surface layer, which may shorten the service life of the photoreceptor. In contrast, a significantly low amount of charge transportable compound increases the number of holes trapped in the surface layer, readily causing irregular density of an electrostatic image.

The surface layer according to the present invention may further contain any component other than the cured resin, the organic resin fine particle, the metal oxide fine particle (or inorganic fine particle) and the charge transportable compound. For example, the surface layer may further contain any antioxidant and any lubricant particle such as an organic resin particle having fluorine atoms. The organic resin fine particle having fluorine atoms should preferably contain at least one substance appropriately selected from the group of polytetrafluoroethylene resin, trifluorochloroethylene resin, hexafluoride chloride ethylene propylene resin, polyvinyl fluoride resin, polyvinylidene fluoride resin, difluoride dichloride ethylene resin, and a copolymer thereof. Particularly preferred are polytetrafluoroethylene and polyvinylidene fluoride.

The surface layer should preferably have a thickness of 0.2 to 10 μm, more preferably 0.5 to 6 μm.

The components other than the surface layer of the photoreceptor having the layer-structure (1) will now be described.

[Conductive Support]

Any conductive support can be used for the photoreceptor of the present invention. Examples of the conductive support include metal, such as aluminum, copper, chrome, nickel, zinc, and stainless steel, molded into a drum or sheet; a plastic film laminated with a metal foil of aluminum or copper; a plastic film having aluminum, indium oxide, or tin oxide deposited thereon; and metal, a plastic film, or a paper sheet having a conductive layer formed by applying a conductive substance alone or in combination with a binder resin.

(Intermediate Layer)

The photoreceptor of the invention may include an intermediate layer functioning as a barrier and a bonding agent between the electrically conductive support and the photosensitive layer. The intermediate layer is preferably provided to avoid failures.

The intermediate layer is composed, for example, of a binder resin (hereinafter also referred to as "binder resin for the intermediate layer") and optional conductive particles or metal oxide particles.

Examples of the binder resin for the intermediate layer include, casein, polyvinyl alcohol, nitrocellulose, ethylene-acrylic acid copolymer, polyamide resin, polyurethane resign and gelatin. Among these materials, alcohol-soluble polyamide resin is preferred.

Various electrically conductive particles or metal oxide particles may be contained in the intermediate layer to control the resistivity. Examples thereof include metal oxide particles, such as particles of alumina, zinc oxide, titanium oxide, tin oxide, antimony oxide, indium oxide, and bismuth oxide. Furthermore, ultra-fine particles, such as particles of tin-doped indium oxide, antimony-doped tin oxide, and antimony-doped zirconium oxide can be used. The number-average diameter of primary particles of the metal oxide is preferably 0.3 μm or less and more preferably 0.1 μm or less.

These metal oxides particles can be used alone or in combination. In the combination of two or more particulate metal oxides, the particulate metal oxides may be in the form solid solution or fusion.

The amount of the conductive particles or the metal oxide particles is in the range of preferably 20 to 400 parts by mass, more preferably 50 to 350 parts by mass, relative to 100 parts by mass of the binder resin.

The thickness of the intermediate layer is in the range of preferably 0.1 to 15 μm and more preferably 0.3 to 10 μm.

(Charge Generation Layer)

The charge generation layer in the photosensitive layer of the photoreceptor of the invention contains a charge generating material and a binder resin (hereinafter also referred to as "binder resin for the charge generating layer").

Examples of the charge generating material include, but not limited to, azo compounds, such as Sudan Red and Diane Blue; quinone pigments, such as pyrene quinone and anthanthrone; quinocyanine pigments; perylene pigments; indigo pigments, such as indigo and thioindigo; polycyclic quinone pigments, such as pyranthrone and diphthaloylpylene; and phthalocyanine pigments. Among these materials, polycyclic quinone pigments, titanylphthalocyanine pigment are preferred. These charge generating materials can be used alone or in combination.

Non-limiting examples of the binder resin for the charge generating layer include known resins, such as polystyrene resins, polyethylene resins, polypropylene resins, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, copolymer resins containing at least two of these resin structures (e.g., vinyl chloride-vinyl acetate copolymer resins, and vinyl chloride-vinyl acetate-maleic anhydride copolymer resins), and polyvinylcarbazole resins. Among these materials, polyvinyl butyral resins are preferred.

The amount of the charge generating material in the charge generating layer is in the range of preferably 1 to 600 parts by mass, and more preferably 50 to 500 parts by mass, relative to 100 parts by mass of the binder resin for the charge generating layer.

The thickness of the charge generation layer varies depending on the properties of the charge generating material, the properties of the binder resin for the charge generating layer, and the mixing ratio thereof, and ranges from preferably 0.01 to 5 μm, and more preferably 0.05 to 3 μm.

(Charge Transport Layer)

A charge transport layer in the photosensitive layer of the photoreceptor of the invention contains a charge transport material and a binder resin (hereinafter also referred to as "binder resin for the charge transport layer").

Examples of the charge transport material in the charge transport layer include triphenylamine derivatives, hydrazone compounds, styryl compounds, benzidine compounds, and butadiene compounds.

Examples of the binder resin for the charge transport layer include known resins, such as polycarbonate resins, polyacrylate resins, polyester resins, polystyrene resins, styrene-acrylonitrile copolymer resins, polymethacrylate resins, and styrene-methacrylate copolymer resins. In particular, polycarbonate resins are preferred. In particular, polycarbonate resins, such as Bisphenol A (BPA), Bisphenol Z (BPZ), dimethyl BPA, and BPA-dimethyl BPA copolymers, are preferred in view of cracking resistance, abrasion resistance, and electrostatic-charging characteristics.

The amount of charge transport material in the charge transport layer is in the range of preferably 10 to 500 parts by mass, more preferably 20 to 250 parts by mass, relative to 100 parts by mass of the binder resin for the charge transport layer.

The thickness of the charge transport layer varies depending on the properties of the charge transport material and the binder resin for the charge transport layer, and the proportion thereof, and ranges from preferably from 5 to 40 μm, more preferably from 10 to 30 μm.

The charge transport layer may contain antioxidant, electron conductive agent, stabilizer, and/or silicone oil, for example. Preferred are the antioxidants listed in JP 2000-305291 and the electron conductive agent in JP S50-137543 and JP 58-76483, for example.

With the above photoreceptor, cured resin in the surface layer contains organic resin fine particles of at least one of melamine resin and benzoguanamine resin, and metal oxide fine particles, and the organic resin fine particles have a predetermined range of size, thereby achieving an excellent cleaning operation while preventing the irregular density of a formed image.

[Method of Manufacturing Photoreceptor]

The photoreceptor according to the invention can be manufactured, for example, through the following steps:

Step (1): applying a coating solution for an intermediate layer onto the external surface of a conductive support and drying the surface to form an intermediate layer;

Step (2): applying a coating solution for a charge generating sublayer onto the external surface of the intermediate layer formed on the conductive support and drying the surface to form a charge generating sublayer;

Step (3): applying a coating solution for a charge transportable sublayer onto the external surface of the charge generating sublayer formed on the intermediate layer and drying the surface to form a charge transportable sublayer; and Step (4): applying a coating solution for a surface layer onto the external surface of the charge transportable sublayer formed on the charge generating sublayer to forma coating film, and curing the coating film to form a surface layer.

[Step (1): Formation of Intermediate Layer]

A binder resin for an intermediate layer is dissolved in a solvent to prepare a coating solution (hereinafter also referred to as "coating solution for an intermediate layer"). Conductive particles and metal oxide particles are dispersed in the coating solution as required. The coating solution is applied onto a conductive support into a uniform thickness to form a coating film. The coating film is then dried. This process yields an intermediate layer.

The conductive particles and the metal oxide particles may be dispersed in the coating solution for an intermediate layer with any device, such as an ultrasonic disperser, a ball mill, a sand mill, or a homomixer.

Examples of the technique of applying the coating solution for an intermediate layer include known techniques, such as dip coating, spray coating, spinner coating, bead coating, blade coating, beam coating, slide-hopper coating, and circular slide-hopper coating.

The technique of drying the coating film can be appropriately selected depending on the type of the solvent and the thickness of the coating film. A thermal drying operation is preferred.

The formation of the intermediate layer can use any solvent provided that the solvent can well disperse the conductive particles and the metal oxide particles and can solve the binder resin for an intermediate layer. In specific, alcohols having a carbon number of 1 to 4, such as methyl alcohol, ethyl alcohol, n-propyl alcohol, isopropyl alcohol, n-butyl alcohol, t-butyl alcohol, and sec-butyl alcohol, are preferred because such alcohols have high solubility to the binder resin and ready coating characteristics. In order to improve the preservation and the dispersion of the particles, an auxiliary solvent may be added. Examples of the auxiliary solvent that is compatible with the primary solvent and can provide preferred effects include benzyl alcohol, toluene, methylene chloride, cyclohexanone, and tetrahydrofuran.

The concentration of the binder resin for an intermediate layer in the coating solution for an intermediate layer is appropriately selected depending on the thickness of the intermediate layer and the production rate.

[Step (2): Formation of Charge Generating Sublayer]

A binder resin for a charge generating sublayer is dissolved in a solvent and a charge generating compound is dispersed in the resulting solution to prepare a coating solution (hereinafter also referred to as "coating solution for a charge generating sublayer"). The coating solution is applied onto the intermediate layer into a uniform thickness to form a coating film. The coating film is then dried. This process yields a charge generating sublayer.

The charge generating compound may be dispersed in the coating solution for a charge generating sublayer with any device, such as an ultrasonic disperser, a ball mill, a sand mill, or a homomixer.

Examples of the technique of applying the coating solution for a charge generating sublayer include known techniques, such as dip coating, spray coating, spinner coating, bead coating, blade coating, beam coating, slide-hopper coating, and circular slide-hopper coating.

The technique of drying the coating film can be appropriately selected depending on the type of the solvent and the thickness of the coating film. A thermal drying operation is preferred.

The formation of the charge generating sublayer may use any solvent, such as toluene, xylene, methylene chloride, 1,2-dichloroethane, methyl ethyl ketone, cyclohexane, ethyl acetate, t-butyl acetate, methanol, ethanol, propanol, butanol, methyl cellosolve, 4-methoxy-4-methyl-2-pentanone, ethyl cellosolve, tetrahydrofuran, 1-dioxane, 1,3-dioxolane, pyridine, and diethylamine.

[Step (3): Formation of Charge Transportable Sublayer]

A binder resin for a charge transportable sublayer and a charge transportable compound are dissolved in a solvent to prepare a coating solution (hereinafter also referred to as "coating solution for a charge transportable sublayer"). The coating solution is applied onto the charge generating sublayer into a uniform thickness to form a coating film. The coating film is then dried. This process yields a charge transportable sublayer.

Examples of the technique of applying the coating solution for a charge transportable sublayer include known techniques, such as dip coating, spray coating, spinner coating, bead coating, blade coating, beam coating, slide-hopper coating, and circular slide-hopper coating.

The technique of drying the coating film can be appropriately selected depending on the type of the solvent and the thickness of the coating film. A thermal drying operation is preferred.

The formation of the charge transportable sublayer may use any solvent, such as toluene, xylene, methylene chloride, 1,2-dichloroethane, methyl ethyl ketone, cyclohexanone, ethyl acetate, butyl acetate, methanol, ethanol, propanol, butanol, tetrahydrofuran, 1,4-dioxane, 1,3-dioxolane, pyridine, and diethylamine.

[Step (4): Formation of Surface Layer]

A polyfunctional radically polymerizable compound, organic resin fine particles, metal oxide fine particles (or inorganic fine particles), a polymerization initiator, and any other required component are added in a known solvent to prepare a coating solution (hereinafter also referred to as "coating solution for a surface layer"). The coating solution for a surface layer is applied onto the external surface of the charge transportable sublayer formed in Step (3) to form a coating film. The coating film is then dried and irradiated with actinic rays, such as uv rays or electron beams, to polymerize the radically polymerizable compound in the coating film. This process yields a surface layer.

If the surface layer is treated by the reaction of a polyfunctional radically polymerizable compound and a surface-treating agent of a compound composed of metal oxide fine particles containing a radically polymerizable functional group, during a coating, drying, or curing process, the reaction of the radically polymerizable functional group in the surface-treating agent and the radically polymerizable functional group in the polyfunctional radically polymerizable compound is promoted to yield a cross-linked cured resin.

The amount of organic resin fine particles in the coating solution for the surface layer is preferably in the range of 5-50 parts by mass, more preferably 5-40 parts by mass, most preferably 10-30 parts by mass relative to 100 parts by mass of all the monomers (polyfunctional radically polymerizable compound and monofunctional radically polymerizable compound) for the cured resin.

The amount of metal oxide fine particles in the coating solution for the surface layer is preferably in the range of 60-100 parts by mass, more preferably 70-90 parts by mass relative to 100 parts by mass of all the monomers (polyfunctional radically polymerizable compound and monofunctional radically polymerizable compound) for the cured resin.

The amount of inorganic fine particles in the coating solution for the surface layer is preferably in the range of 50-200 parts by mass, more preferably 70-180 parts by mass relative to 100 parts by mass of all the monomers (polyfunctional radically polymerizable compound and monofunctional radically polymerizable compound) for the cured resin.

Examples of the means for dispersing organic resin fine particles and metal oxide fine particles (or inorganic fine particles) into the coating solution for the surface layer include, but not limited to, an ultrasonic disperser, a ball mill, a sand mill, and a homo mixer.

The surface layer may be formed with any solvent that can dissolve or disperse polyfunctional radically polymerizable compounds, organic resin fine particles, and metal oxide fine particles (or inorganic fine particles). Examples of such a solvent include, but not limited to, methyl alcohol, ethyl alcohol, n-propyl alcohol, isopropyl alcohol, n-butyl alcohol, t-butyl alcohol, sec-butyl alcohol, benzyl alcohol, toluene, xylene, methylene chloride, methyl ethyl ketone, cyclohexane, ethyl acetate, butyl acetate, methyl cellosolve, ethyl cellosolve, tetrahydrofuran, 1-dioxane, 1,3-dioxolane, pyridine, and diethylamine.

Examples of the technique of applying the coating solution for a surface layer include known techniques, such as dip coating, spray coating, spinner coating, bead coating, blade coating, beam coating, slide-hopper coating, and circular slide-hopper coating.

The coating solution for a surface layer should preferably be applied with a circular slide-hopper coating device.

The application of the coating solution for a surface layer with the circular slide-hopper coating device will now be explained in detail.

Figure 2:
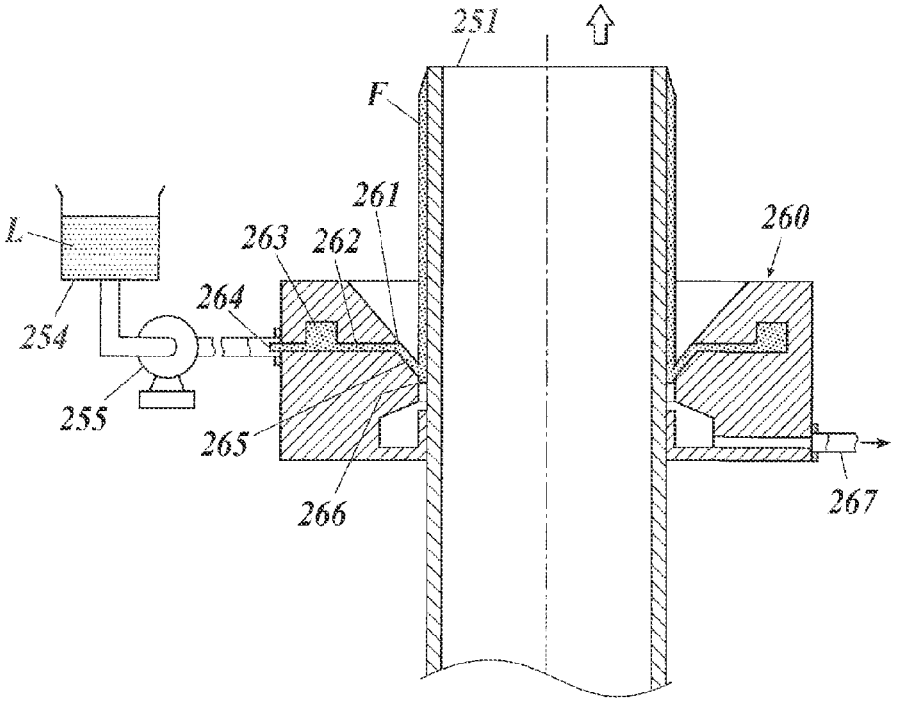
FIG. 2 is a cross-sectional view illustrating an exemplary configuration of a circular slide-hopper coating device used in a manufacturing method of a photoreceptor according to the invention.
Figure 3:
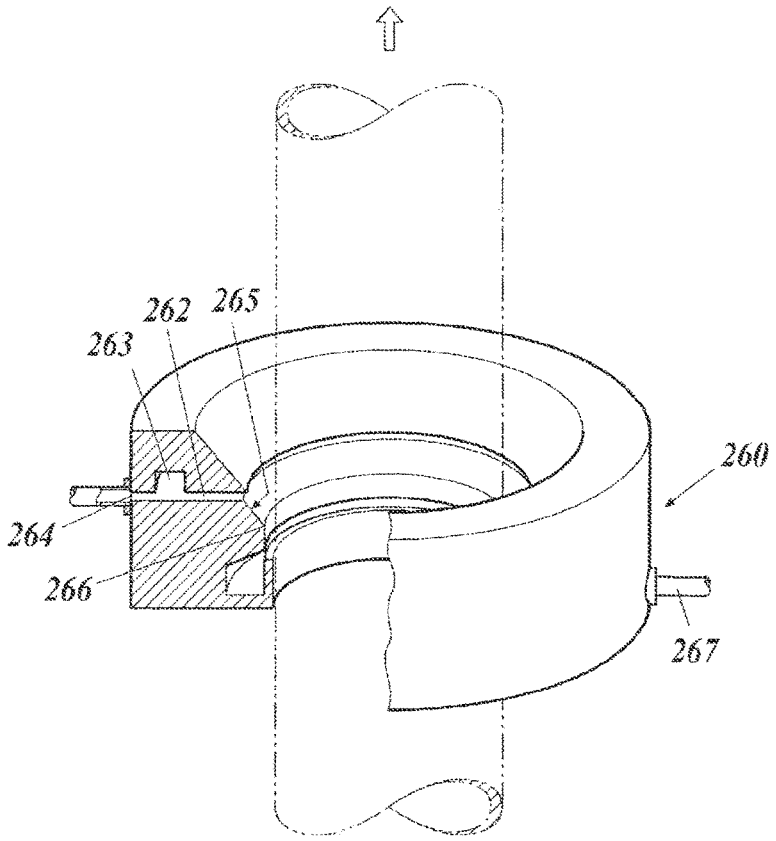
FIG. 3 is a perspective cross-sectional view of the circular slide-hopper coating device illustrated in FIG. 2.

With reference to FIGS. 2 and 3, the circular slide-hopper coating device includes a cylindrical base 251, an annular coating head 260 provided therearound, and a tank 254 for storing a coating solution L.

The cylindrical base 251 to be coated with a coating solution for a surface layer is, for example, a conductive support coated with an intermediate layer and a photosensitive layer (before being coated with a surface layer).

The coating head 260 has a narrow solution dispensing slit 262 extending perpendicularly to the longitudinal direction of the cylindrical base 251 along the entire annular coating head 260. The solution dispensing slit 262 has a solution passage 261 open toward the cylindrical base 251. The solution dispensing slit 262 leads to an annular solution dispensing chamber 263, to which the coating solution L in the tank 254 is supplied through a supplying pipe 264 with a pressure pump 255.

The coating head 260 has a sliding surface 265 below the solution passage 261 of the solution dispensing slit 262. The sliding surface 265 is continuously sloped and has an edge having a slightly larger dimension than the outer dimension of the cylindrical base 251. The coating head 260 further has a lip-like portion (bead or solution pool) 266 extending downward from the edge of the sliding surface 265.

In the circular slide-hopper coating device, the coating solution L discharged from the solution dispensing slit 262 flows down along the sliding surface 265, reaches the edge of the sliding surface 265, forms beads between the edge of the sliding surface 265 and the outer periphery of the cylindrical base 251, and then is applied onto the surface of the cylindrical base 251 to form a coating film F, while the cylindrical base 251 is moving in the direction of an arrow. The excess coating solution L is discharged through the outlet 267.

The edge of the sliding surface and the cylindrical base have a certain clearance (approximately 2 μm to 2 mm) therebetween, so that the circular slide-hopper coating device can apply a coating film without scratching the cylindrical base, or without damaging an underlying layer in the formation of multiple layers having different properties. In addition, the underlying layer is in a solvent for a much shorter period in this method compared to that in the dip coating, so that the components in the underlying layer are barely migrated into the overlying layer or a coating film in the formation of multiple layers that have different properties and are soluble in the same solvent. This application therefore does not impair the dispersion of metal oxide fine particles (or inorganic fine particles) and organic resin fine particles, for example.

Although the coating film can be cured without being dried, the coating film should preferably be cured after an air drying or thermal drying operation.

The conditions of the drying operation can be properly selected depending on the type of the solvent and the thickness of the coating film. The drying temperature should preferably be a room temperature to 180° C., and more preferably be 80° C. to 140° C. The drying period should preferably be 1 to 200 minutes and more preferably be 5 to 100 minutes.

The radically polymerizable compound may be polymerized, for example, by the electron-beam cleavage, or the application of light and/or heat with a radical polymerization initiator. The radical polymerization initiator may be a photopolymerization initiator or a heat polymerization initiator. Alternatively, the photopolymerization initiator and the heat polymerization initiator may be combined.

The radical polymerization initiator should preferably be a photopolymerization initiator. In specific, an alkylphenone compound or a phosphine oxide compound is more preferred, and a compound having an α-hydroxyacetophenone structure or an acylphosphine oxide structure is most preferred.

Specific examples of the acylphosphine oxide compound functioning as the photopolymerization initiator are illustrated below:

[Chemical formula 8]

P1

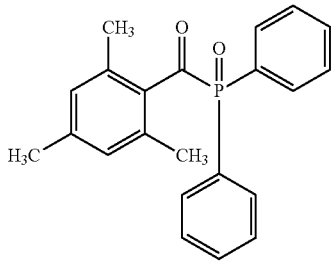

P2

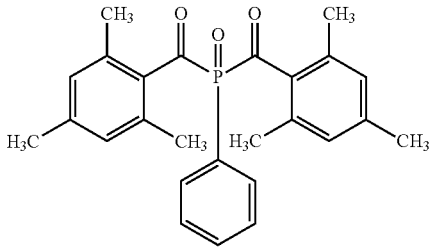

The polymerization initiators may be used alone or in combination of two or more types.

The ratio of the polymerization initiator to the radically polymerizable compound (100 parts by mass) should preferably be 0.1 to 20 parts by mass, and more preferably be 0.5 to 10 parts by mass.

The coating film is irradiated with actinic rays to generate radicals that initiate polymerization and intramolecular and intermolecular cross-linking reactions to cure the resin. The actinic rays should more preferably be uv rays or electron beams. The uv rays, which are easy to use, are most preferred.

Any uv source that emits uv rays can be used. Examples of the uv source include a low-pressure mercury-vapor lamp, a middle-pressure mercury-vapor lamp, a high-pressure mercury-vapor lamp, an ultra-high-pressure mercury-vapor lamp, a carbon-arc lamp, a metal halide lamp, a xenon lamp, and a flash (pulsed) xenon lamp.

The conditions of emitting actinic rays vary depending on the type of the lamp. The amount of emission is generally 5 to 500 mJ/cm$^2$, and should preferably be 5 to 100 mJ/cm$^2$.

The power of the lamp should preferably be 0.1 to 5 kW, and more preferably be 0.5 to 3 kW.

Any electron-beam emitting device that emits electron beams can be used. A typical effective device for emitting electron beams is a curtain-beam accelerator, which is relatively inexpensive and can provide high output. The accelerating voltage during the emission of electron beams should preferably be 100 to 300 kV. The absorbed dose should preferably be 0.5 to 10 Mrad.

The time for the emission of a necessary amount of actinic rays should preferably be 0.1 second to 10 minutes, and more preferably be 0.1 second to 5 minutes in terms of operational efficiency.

In the step of forming the surface layer, the coating film can be dried before, during, and/or after being irradiated with actinic rays. The coating film can be appropriately dried at any one or any combination of the three timings.

[Toner]

The image-forming apparatus including the photoreceptor according to the invention and the image-forming method using the photoreceptor according to the invention may use any toner, and should preferably use a toner having a shape factor SF of smaller than 140 (relative to a spherical particle having a shape factor SF of 100). The toner having a shape factor SF of smaller than 140 has excellent transferring characteristics, leading to an improvement in the quality of a formed image. The particles of the toner should preferably have a volume average diameter of 2 to 8 μm to improve the image quality.

The toner particle typically contains a binder resin and a colorant, and may contain a mold releasing agent if desired. Each of the binder resin, colorant, and mold releasing agent is any material used in a conventional toner.

The toner particles may be manufactured through any method. Examples of the method include a typical pulverizing operation, wet melting conglobation in dispersion media, and known polymerization, such as suspension polymerization, dispersion polymerization, and emulsion polymerization coagulation.

The toner particles may contain appropriate amounts of additives, such as inorganic fine particles composed of silica and titania having an average diameter of approximately 10 to 300 nm, and a polishing agent having a diameter of approximately 0.2 to 3 μm. The toner particles may be mixed with carriers composed of ferrite beads having an average diameter of 25 to 45 μm into a two-component developer.

[Image-Forming Apparatus]

The image-forming apparatus according to the invention includes a photoreceptor, a charging unit to charge the surface of the photoreceptor, an exposing unit to form an electrostatic latent image on the surface of the photoreceptor, a developing unit to develop the electrostatic latent image with a toner into a toner image, a transferring unit to transfer the toner image onto a transfer medium, a fixing unit to fix the transferred toner image on the transfer medium, a cleaning unit to remove a residual toner from the photoreceptor, and a lubricant applying mechanism to apply a lubricant onto the surface of the photoreceptor. The photoreceptor is the photoreceptor according to the invention. For example, the lubricant applying mechanism is disposed ahead of the cleaning blade and includes a solid lubricant, a brush to scrape the lubricant and supply the lubricant to the photoreceptor, a driving source to drive the brush, and a casing accommodating these components. Any other lubricant applying mechanism may also be used.

The charging unit should preferably be of a contact or contactless roller discharging mechanism.

Figure 4:
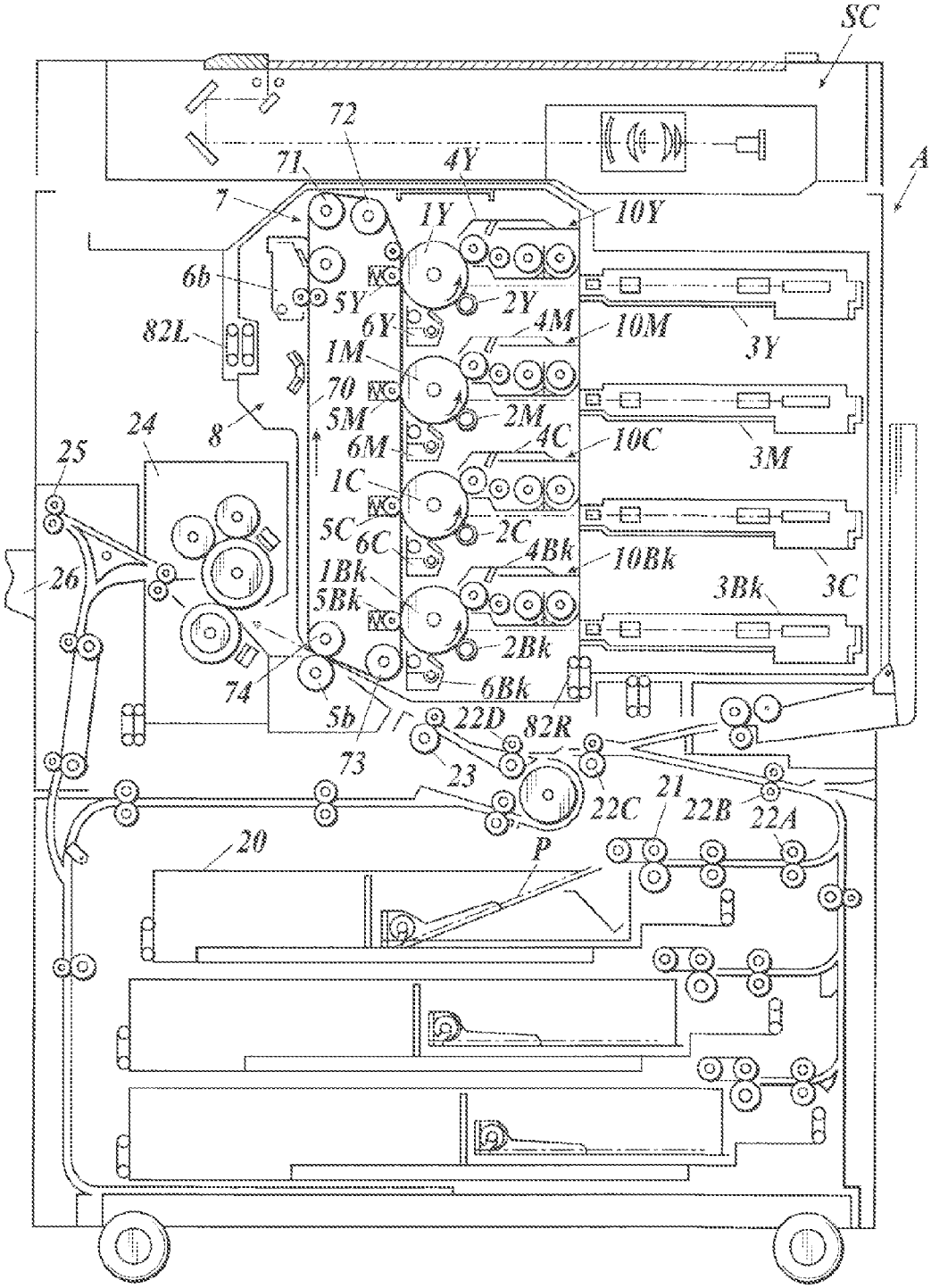
FIG. 4 is a cross-sectional view illustrating an exemplary configuration of an image-forming apparatus according to the invention.

FIG. 4 is a cross-sectional view illustrating an exemplary configuration of the image-forming apparatus according to the invention.

The image-forming apparatus, which is called a tandem color image-forming apparatus, includes four image-forming units 10Y, 10M, 10C, and 10Bk, an endless-belt intermediate transferring unit 7, a sheet feeding unit 21, and a fixing unit 24. The image-forming apparatus further includes a document reading apparatus SC above a body A of the image-forming apparatus.

The image-forming unit 10Y for forming a yellow image includes a drum photoreceptor 1Y, a charging unit 2Y, an exposing unit 3Y, a developing unit 4Y, a first transferring roller 5Y (first transferring unit), and a cleaning unit 6Y, which are arranged around the drum photoreceptor 1Y. The image-forming unit 10M for forming a magenta image includes a drum photoreceptor 1M, a charging unit 2M, an exposing unit 3M, a developing unit 4M, a first transferring roller 5M (first transferring unit), and a cleaning unit 6M. The image-forming unit 10C for forming a cyan image includes a drum photoreceptor 1C, a charging unit 2C, an exposing unit 3C, a developing unit 4C, a first transferring roller 5C (first transferring unit), and a cleaning unit 6C. The image-forming unit 10Bk for forming a black image includes a drum photoreceptor 1Bk, a charging unit 2Bk, an exposing unit 3Bk, a developing unit 4Bk, a first transferring roller 5Bk (first transferring unit), and a cleaning unit 6Bk. Each of the photoreceptors 1Y, 1M, 1C, and 1Bk in the image-forming apparatus according to the invention is the photoreceptor according to the invention.

The four image-forming units 10Y, 10M, 10C, and 10Bk respectively include the photoreceptor 1Y, 1M, 1C and 1Bk at the center, the charging unit 2Y, 2M, 2C and 2Bk, the exposing unit 3Y, 3M, 3C and 3Bk, the rotatable developing unit 4Y, 4M, 4C and 4Bk, and the cleaning unit 6Y, 6M, 6C and 6Bk for cleaning the photoreceptor 1Y, 1M, 1C and 1Bk.

The image-forming units 10Y, 10M, 10C, and 10Bk have the same configuration except for the colors of toner images formed on the photoreceptors 1Y, 1M, 1C, and 1Bk. The following description focuses on the image-forming unit 10Y.

The image-forming unit 10Y includes the charging unit 2Y, the exposing unit 3Y, the developing unit 4Y, and the cleaning unit 6Y around the photoreceptor 1Y (image carrier). The image-forming unit 10Y forms a yellow (Y) toner image on the photoreceptor 1Y. In the image-forming unit 10Y according to the present embodiment, at least the photoreceptor 1Y, the charging unit 2Y, the developing unit 4Y, and the cleaning unit 6Y are integrated.

The charging unit 2Y provides the photoreceptor 1Y with uniform potential. According to the invention, the charging unit 2Y should preferably be of a contact or contactless roller discharging mechanism. Although AC bias voltage should preferably be superimposed on DC bias voltage in terms of the image quality, DC bias voltage alone can also be applied.

The charging unit 2Y of a contact or contactless roller discharging mechanism can significantly reduce the generation of ozone and can lower the voltage to be applied, compared to that of the corona discharging mechanism, leading to power and space saving.

The exposing unit 3Y exposes the photoreceptor 1Y provided with the uniform potential by the charging unit 2Y in response to image signals (yellow) to form an electrostatic latent image corresponding to the yellow image. For example, the exposing unit 3Y includes LEDs including luminous elements arranged in an array in the axial direction of the photoreceptor 1Y and an imaging element, or includes a laser optical device.

The developing unit 4Y includes, for example, a rotatable developing sleeve including a magnet therein and retaining a developer thereon, and a voltage applying device to apply DC and/or AC bias voltage between the photoreceptor 1Y and the developing sleeve.

For example, the fixing unit 24 is a heating roller fixing unit that includes a heating roller having an internal heat source and a pressure roller in a pressure contact with the heating roller to form a fixation nip.

The cleaning unit 6Y includes a cleaning blade and a brush roller disposed upstream of the cleaning blade.

Figure 5:
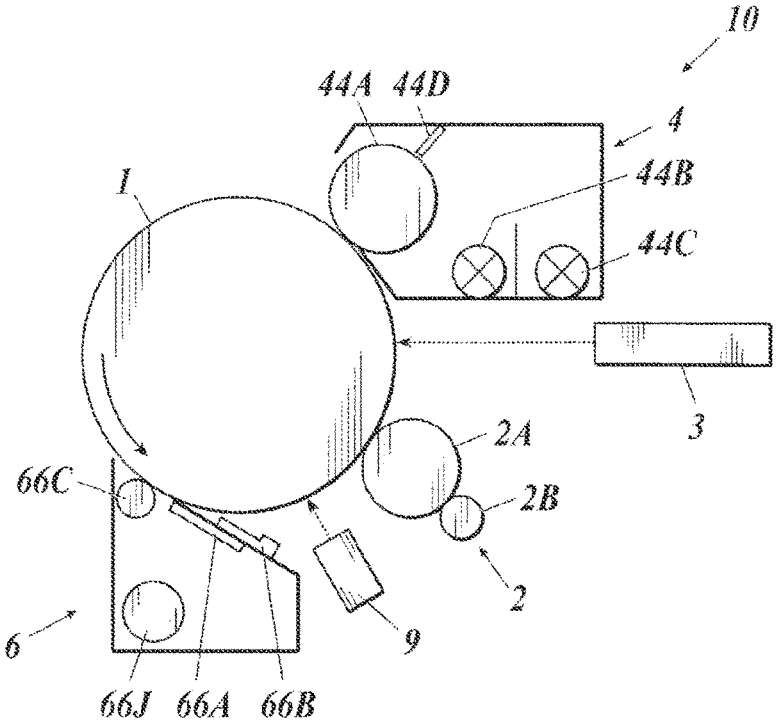
FIG. 5 is a cross-sectional view illustrating an exemplary configuration of an image-forming unit in an image-forming apparatus according to the invention.

In specific, with reference to FIG. 5, each cleaning unit 6 includes a cleaning blade 66A having an edge abutting the surface of the photoreceptor 1, and a brush roller 66C that is disposed upstream of the cleaning blade 66A and abuts the surface of the photoreceptor 1.

FIG. 5 also illustrates a charging roller 2A, a cleaning roller 2B, a static eliminator 9, a developing roller 44A, a supplying screw 44B, a conveyor screw 44C, a limiting blade 44D, and a conveyor screw 66J.

The cleaning blade 66A removes a residual toner from the photoreceptor 1 and scrapes the surface of the photoreceptor 1.

The cleaning blade 66A is supported by a support 66B. The cleaning blade 66A is composed of an elastic rubber, such as a urethane rubber, a silicone rubber, a fluorinated rubber, a chloroprene rubber, or a butadiene rubber. The urethane rubber is more preferred because it has superior wear characteristics to any other rubber.

The support 66B is composed of a metal or plastic plate. Examples of the metal plate include a stainless steel plate, an aluminum plate, and a damping steel plate.

According to the invention, the edge of the cleaning blade 66A should preferably abut the surface of the photoreceptor 1 while applying a load to the surface in the direction (counter direction) opposite to the rotational direction of the photoreceptor 1. The edge of the cleaning blade 66A and the photoreceptor 1 should preferably define an abutting surface therebetween, as illustrated in FIG. 5.

Figure 6:
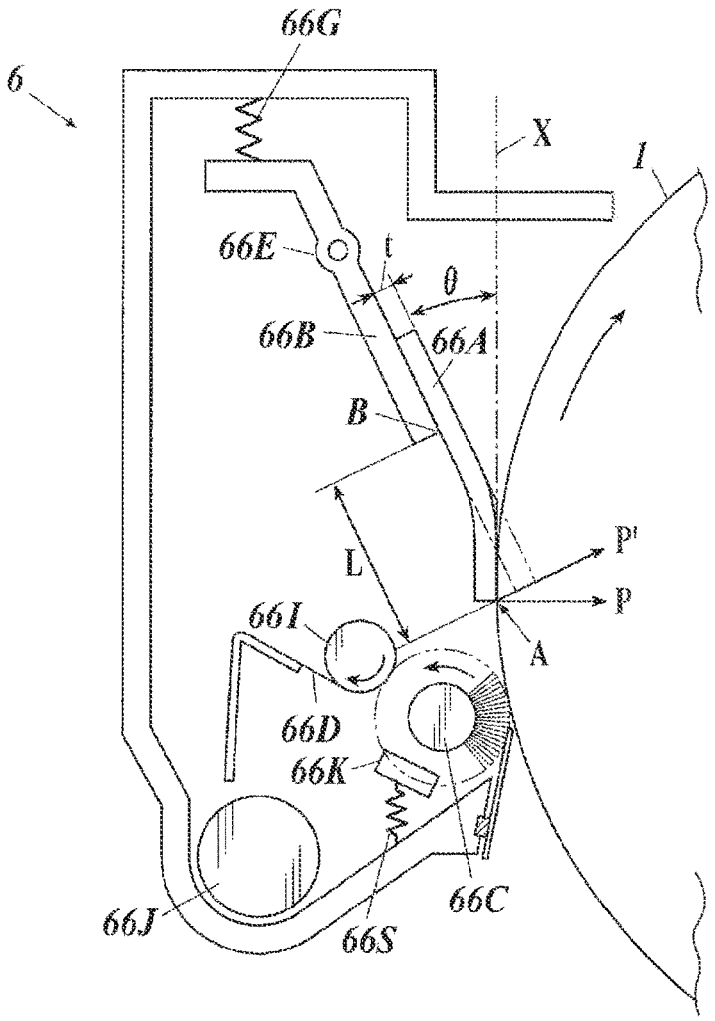
FIG. 6 is a cross-sectional view illustrating an exemplary configuration of a cleaning unit in an image-forming apparatus according to the invention.

With reference to FIG. 6, the abutting load P of the cleaning blade 66A on the photoreceptor 1 should preferably be 5 to 40 N/m, whereas the abutting angle θ should preferably be 5° to 35°.

The abutting load P indicates a vector value in the normal direction of the abutting force P' of the cleaning blade 66A on the drum photoreceptor 1.

The abutting angle θ indicates an angle defined by the undeformed blade and a tangent X of the photoreceptor 1 at an abutting position A.

The reference numeral 66E indicates a rotary shaft for enabling the rotation of the support 66B, and the reference numeral 66G indicates a loading spring.

The free length L of the cleaning blade 66A should preferably be 6 to 15 mm.

The free length L of the cleaning blade 66A indicates the length from an end B of the support 66B to the edge of the undeformed cleaning blade 66A, as illustrated in FIG. 6.

The thickness t of the cleaning blade 66A should preferably be 0.5 to 10 mm.

The thickness t of the cleaning blade 66A indicates the length perpendicular to the surface bonded to the support 66B, as illustrated in FIG. 6.

The brush roller 66C removes the residual toner from the photoreceptor 1, collects the residual toner removed by the cleaning blade 66A, and scrapes the surface of the photoreceptor 1. In specific, the brush roller 66C abutting the surface of the photoreceptor 1 rotates in the same direction as the photoreceptor 1 at the abutting portion, to remove the residual toner and paper dust from the photoreceptor 1, to collect and convey the residual toner removed by the cleaning blade 66A to the conveyor screw 66J, and to scrape and refresh the surface of the photoreceptor 1.

The removed deposits such as the residual tonner transferred from the photoreceptor 1 to the brush roller 66C should preferably be removed by a flicker 66I (removing unit) abutting on the brush roller 66C. The tonner adhering to the flicker 66I is removed by a scraper 66D and is collected by the conveyor screw 66J. The collected toner is discarded to the outside, or recycled to the developing unit 4 through a toner recycling pipe (not shown).

The flicker 66I should preferably be composed of a metal tube, such as a stainless steel or aluminum tube.

The scraper 66D should preferably be a flexible plate composed of phosphor bronze, poly(ethylene terephthalate), or polycarbonate, and abut the flicker 66I in a counter manner such that the edge of the scraper 66D defines an acute angle from the rotational direction of the flicker 66I.

The cleaning unit 6 further includes a lubricant applying mechanism for applying a lubricant onto the surface of the photoreceptor 1.

In specific, the cleaning unit 6 includes a solid lubricant 66K urged onto the brush roller 66C by a loading spring 66S, as illustrated in FIG. 6. The solid lubricant 66K is scraped and applied onto the surface of the photoreceptor 1 by the rotating brush roller 66C.

A specific example of the lubricant is zinc stearate.

The brush roller 66C is electrically conductive or semiconductive. The brush roller 66C may be composed of any material, preferably hydrophobic high-dielectric-constant fiber-forming polymer. Examples of such polymer include rayon, nylon, polycarbonate, polyester, methacrylic resins, acrylic resins, polyvinyl chloride, polyvinylidene chloride, polypropylene, polystyrene, polyvinyl acetate, styrene-butadiene copolymer, vinylidene chloride-acrylonitrile copolymer, vinyl chloride-vinyl acetate copolymers, vinyl chloride-vinyl acetate-maleic anhydride copolymer, silicone resins, silicone-alkyd resins, phenol formaldehyde resins, styrene-alkyd resins, and polyvinyl acetal (e.g., polyvinyl butyral). These resins can be used alone or in combination. Preferred are rayon, nylon, polycarbonate, polyester, acrylic resins, and polypropylene.

The brush roller 66C may be conductive or semiconductive. The brush roller 66C may contain a low resistance material such as carbon to have any desired specific resistance.

Each hair of the brush roller 66C should preferably have a thickness of 5 to 20 denier.

The brush roller 66C including hairs having a thickness of 5 to 20 denier can provide sufficient scraping force to certainly remove the deposits from the surface of the photoreceptor 1 without scratching or wearing the surface.

The term "denier" indicates the weight in gram (g) of a 9000-m length of the hair (fiber) of the brush roller 66C.

The density of the hairs of the brush roller 66C (the number of hairs per 1 $cm^2$) is $4.5\times10^2$/cm to $2.0\times10^4$/cm.

A brush roller 66C having a hair density of lower than $4.5\times10^2$/cm will have low stiffness and low and uneven scraping force and thus cannot evenly remove the deposits. A brush roller 66C having a hair density of higher than $2.0\times10^4$/cm will have high stiffness and high scraping force and thus will cause excess wear of the photoreceptor 1. The reduced sensitivity of the photoreceptor 1 would cause fog, and the scratches would cause black lines in an image.

The brush roller 66C should preferably overlap with the photoreceptor 1 by a length of 0.4 to 1.5 mm.

The overlapping length indicates a load on the brush roller 66C caused by the relative motion between the drum photoreceptor 1 and the brush roller 66C. For the drum photoreceptor 1, the load corresponds to the scraping force received from the brush roller 66C. The definition of the load range indicates the necessity of appropriate scraping force on the photoreceptor 1.

The overlapping length is defined as the length of the hairs overlapping with the photoreceptor 1 if the hairs do not bend at the surface of the photoreceptor 1 and dig straight into the photoreceptor 1 while the brush roller 66C is abutting the photoreceptor 1.

The brush roller 66C may include any roller core. A typical roller core is composed of a metal such as stainless steel or aluminum, paper, or a plastic.

The brush roller 66C should preferably rotate such that the abutting portion of the brush roller 66C moves in the same direction as the surface of the photoreceptor 1. If the abutting portion moved in the opposite direction, excess toner removed from the surface of the photoreceptor 1 by the brush roller 66C might be spilled to contaminate a sheet and/or the apparatus.

In the photoreceptor 1 and the brush roller 66C rotating in the same direction, the ratio of their surface velocity should preferably be within the range of 1:1.1 to 1:2.

According to the invention, the components, such as the photoreceptor, the developing unit, and the cleaning unit may be integrated into each of the processing cartridges (image-forming units) that can be detachably attached to the body of the image-forming apparatus. Alternatively, the photoreceptors and at least one group of the charging units, the exposing units, the developing units, the transferring units, and the cleaning units may be integrally supported to define a single processing cartridge (image-forming unit) that can be detachably attached to the apparatus body with a guiding unit such as rails in the apparatus body.

The endless-belt intermediate transferring unit 7 includes an endless semiconductive intermediate transferring belt 70 (second image carrier) wound around and rotatably supported by multiple rollers.

The images of the respective colors formed by the image-forming units 10Y, 10M, 10C, and 10Bk are sequentially transferred onto the revolving intermediate transferring belt 70 with the respective first transferring rollers 5Y, 5M, 5C, and 5Bk (first transferring units), to forma synthesized color image. A transfer medium P (an image retainer to retain a fixed final image; e.g., a plain paper or a transparent sheet) accommodated in a sheet feeding cassette 20 is fed by the sheet feeding unit 21, and is transported to a second transferring roller 5*b* (second transferring units) via multiple intermediate rollers 22A, 22B, 22C, and 22D and register rollers 23. The color image on the intermediate transferring belt 70 is transferred at once onto the transfer medium P in a second transferring operation. The color image transferred on the transfer medium P is fixed by the fixing unit 24. The transfer medium P is then pinched between discharging rollers 25 and is conveyed to a sheet receiving tray 26 outside the apparatus. The image retainers for retaining a toner image transferred from the photoreceptor, such as the intermediate transferring belt and the transfer medium, are collectively called transferring media.

After the transfer of the color image onto the transfer medium P with the second transferring roller 5*b* (second transferring units) and the spontaneous separation of the transfer medium P from the turning intermediate transferring belt 70, the residual toner on the intermediate transferring belt 70 is removed by the cleaning unit 6*b*.

The first transferring roller 5Bk is in contact with the photoreceptor 1Bk all the time during the image formation. The first transferring rollers 5Y, 5M, and 5C are in contact with the respective photoreceptors 1Y, 1M, and 1C only during the formation of a color image.

The second transferring roller 5*b* is in contact with the intermediate transferring belt 70 only while the transfer medium P is passing therebetween for the second transferring operation.

A housing 8 can be extracted along supporting rails 82L and 82R from the apparatus body A.

The housing 8 accommodates the image-forming units 10Y, 10M, 10C, and 10Bk, and the endless-belt intermediate transferring unit 7.

The image-forming units 10Y, 10M, 10C, and 10Bk are aligned in the vertical direction. The endless-belt intermediate transferring unit 7 is disposed on the left of the photoreceptors 1Y, 1M, 1C, and 1Bk in FIG. 4. The endless-belt intermediate transferring unit 7 includes the intermediate transferring belt 70 rotatably wound around rollers 71, 72, 73, and 74, the first transferring rollers 5Y, 5M, 5C, and 5Bk, and the cleaning unit 6*b*.

Although the image-forming apparatus illustrated in FIG. 4 is a color laser printer, the image-forming apparatus may also be a monochrome laser printer or a copier. The exposure light source may be any light source, such as LEDs, other than the laser.

The image-forming apparatus, which includes the photoreceptor according to the invention, can achieve an excellent cleaning operation and thus can form high-quality images for a long period. Furthermore, the uneven density of an image can be prevented regardless of uneven application of the lubricant.

[Image-Forming Method]

The image-forming method according to the invention includes a charging step of charging the surface of a photoreceptor, an exposing step of forming an electrostatic latent image on the surface of the photoreceptor, a developing step of developing the electrostatic latent image with a toner to forma toner image, a transferring step of transferring the toner image onto a transfer medium, a fixing step of fixing the transferred toner image on the transfer medium, and a cleaning step of removing a residual toner from the photoreceptor. The toner contains a lubricant. The photoreceptor is the photoreceptor according to the invention. The charging step should preferably be performed by a contact or contactless roller discharging mechanism.

The image-forming method according to the invention can be executed by, for example, the image-forming apparatus illustrated in FIG. 4. In the image-forming method according to the invention, the image-forming apparatus should include a lubricant applying mechanism or use a developer containing a lubricant. If the developer contains a lubricant, the lubricant is applied onto the photoreceptor surface by the electrical field for the development in the developing step.

Any lubricant having lubricity and cleavability can be used. A specific example of the lubricant is zinc stearate. The lubricant should preferably have a number average primary particle size of 1 to 20 μm, for example. The lubricant should preferably be contained in the developer in an amount of 0.01% to 0.3% by mass, so as not to affect the electrostatic properties of the toner.

The image-forming method, which uses the photoreceptor according to the invention, can achieve an excellent cleaning operation and thus can form high-quality images for a long period. Furthermore, the uneven density of an image can be prevented regardless of uneven application of the lubricant.

The invention will now be described in detail with reference to examples. The invention should not be limited to the examples. The term "parts" in the following description indicates "parts by mass."

Example 1

Process for Manufacturing Photoreceptor 1

A conductive support 1 was prepared which was a 60-mm-dia aluminum cylinder with a work surface finely roughened by cutting.

(Preparation of Intermediate Layer)

A dispersion having the following composition was diluted two-fold with the following solvent, and allowed to stand overnight. The mixture was filtered (with a Ridimesh 5 μm filter produced by Pall Corporation) to prepare a coating solution for the intermediate layer 1.

| | |
|---|---|
| Binder resin: polyamide resin (CM8000: manufactured by Toray Industries, Inc.) | 1 part |
| Metal oxide particles: Titanium oxide (SMT500SAS: manufactured by TAYCA Corporation) | 3 parts |
| Solvent: methanol | 10 parts |

The composition was dispersed for 10 hours with a sand mill by a batch process.

The coating solution for the intermediate layer 1 was applied onto the conductive support 1 by a dipping coating process so as to prepare an intermediate layer 1 having a dry thickness of 2 μm.

(Preparation of Charge Generating Layer)

Charge generating material: Pigment (CG-1) (20 parts), binder resin: polyvinyl butyral resin (#6000-C: manufactured by DENKI KAGAKU KOGYO K.K.) (10 parts), solvent: t-butyl acetate (700 parts), and solvent: 4-methoxy-4-methyl-2-pentanone (300 parts) were mixed and dispersed with a sand mill for 10 hours to prepare a coating solution for the charge generating layer 1. The coating solution for the charge generating layer 1 was coated on the intermediate layer 1 by a dipping coating process to form a charge generating layer 1 having a dry thickness of 0.3 μm.

Synthesis of Pigment (CG-1)

(1) Synthesis of Amorphous Titanyl Phthalocyanine

In ortho-dichlorobenzene (200 parts), 1,3-diiminoisoindoline (29.2 parts) was dispersed, and then titanium tetra-n-butoxide (20.4 parts) was added, followed by heating for five hours at 150 to 160° C. in nitrogen atmosphere. After air cooling, a precipitated crystal was separated by filtering and was washed with chloroform and then with an aqueous 2% hydrochloric acid solution, followed by washing with water then methanol, and drying to give crude titanyl phthalocyanine (26.2 parts, yield: 91%).

The raw titanyl phthalocyanine was dissolved in concentrated sulfuric acid (250 parts) with stirring at 5° C. or less for one hour and then the mixture was poured into water (5,000 parts) of 20° C. The precipitated crystal was filtered and sufficiently washed with water to give a wet paste product (225 parts by mass).

The wet paste product was then frozen in a freezer and then the crystalline product was melted, followed by filtration and drying to give amorphous titanyl phthalocyanine (24.8 parts, yield: 86%).

(2) Synthesis of Adduct of Titanyl Phthalocyanine and (2R,3R)-2,3-butanediol (CG-1)

The above amorphous titanyl phthalocyanine (10.0 parts) and (2R,3R)-2,3-butanediol (0.94 parts, molar ratio=0.6 where the molar ratio is relative to titanyl phthalocyanine, hereinafter, the same definition holds) were mixed into o-dichlorobenzene (ODB) (200 parts) and then stirred with heating at 60 to 70° C. for 6.0 hours. After being allowed to stand overnight, crystals formed by adding methanol to the reaction mixture were separated by filtering and washed with methanol to give CG-1 pigment: an adduct of titanyl phthalocyanine and (2R,3R)-2,3-dutanediol (10.3 parts). The X-ray diffraction spectrum of the pigment (CG-1) had clear peaks at 8.3°, 24.7°, 25.1°, and 26.5°. The mass spectrum had peaks at 576 and 648. The IR spectrum had the absorptions of Ti═O and O—Ti—O at a 970 $cm^{-1}$ region and a 630 $cm^{-1}$ region, respectively, were observed. Furthermore, the thermogravimetric analysis (TG) showed a mass reduction of about 7% occurring at 390 to 410° C. These results demonstrate that the product is probably a mixture of a 1:1 adduct of titanyl phthalocyanine and (2R,3R)-2,3-butanediol and a non-adduct (non-added) titanyl phthalocyanine.

The BET specific surface area of the pigment (CG-1) was determined to be 31.2 $m^2/g$ by an automatic fluid specific surface area analyzer (Micrometrics Flowsoap type, manufactured by Shimadzu Corp.).

(Preparation of Charge Transport Layer)

Charge transport material: compound A described below (225 parts), binder resin: polycarbonate resin "Z300" manufactured by Mitsubishi Gas Chemical Co., Inc. (300 parts), antioxidant: "Irganox 1010" manufactured by Nihon Ciba-Geigy (6 parts), solvent: tetrahydrofuran (THF) (1600 parts), solvent: toluene (400 parts), silicone oil "KF-50" manufactured by Shin-Etsu Chemical Co., Ltd. (1 parts) were mixed, and the mixture was dissolved to prepare a coating solution for the charge transport layer 1.

The coating solution for the charge transport layer 1 was applied onto the charge generating layer 1 with a circular slide hopper coater to form a charge transport layer 1 having a dry thickness of 20 μm.

[Chemical formula 9]

化合物 A

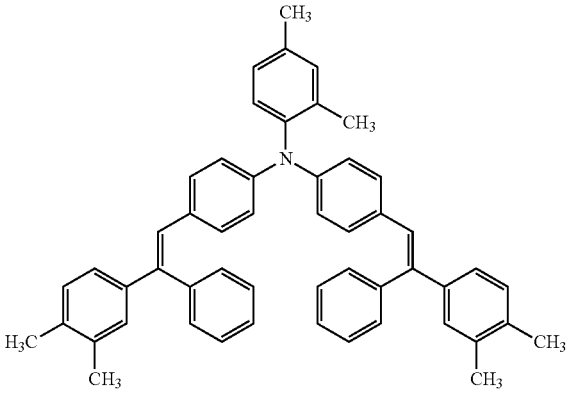

(Formation of Surface Layer)

(1) Preparation of Metal Oxide Fine Particles

Tin oxide (having a number-average primary particle size of 20 nm) (100 parts), surface-treating agent: exemplary compound (S-13) (30 parts), toluene/isopropyl alcohol (1/1 by mass) mixed solvent (300 parts) were mixed. The mixture was agitated together with zirconia beads at a rotational rate of 1500 rpm at about 40° C. The treated mixture was then transferred from the sand mill into a Henschel mixer, and agitated for 15 min at a rotational rate of 1500 rpm. The resulting mixture was dried at 120° C. for three hours to complete the surface-treatment of tin oxide with the compound having the radical polymerizable functional group to prepare a surface-treated metal oxide, which served as metal oxide fine particles 1. The surfaces of the tin oxide particles were covered with the exemplary compound (S-13) having the radical polymerizable functional group after the surface-treatment.

(2) Formation of Surface Layer

Metal oxide fine particles 1 (150 parts), exemplary polyfunctional radically polymerizable organic compound (M1) (100 parts), exemplary charge transport compound (CTM-10) (20 parts) were mixed in the dark. 2-Butanol (400 parts) and tetrahydrofuran (20 parts) were added, and then the mixture was agitated and dispersed with a sand mill for five hours. A polymerization initiator, "Irgacure 819" (manufactured by BASF Japan Ltd.) (12.5 parts), organic resin fine particles: "Epostar S" (manufactured by Nippon Shokubai Co., Ltd.) (10 parts) were added and the mixture was agitated for one hour to prepare a coating solution for the surface layer 1. The coating solution for the surface layer 1 was applied to the charge transport layer 1 with a circular slide hopper coater to form a coating film. The coating film was then irradiated with UV rays for 1 min with a metal halide lamp to form a surface layer 1 having a dry thickness of 2.5 μm. The photoreceptor 1 was thereby prepared.

(Process for Manufacturing Photoreceptors 2-9)

Photoreceptors 2-9 were manufactured as in the photoreceptor 1 except that the type and amount of the organic resin fine particles for forming a surface layer were as shown in Table 1.

(Process for Manufacturing Photoreceptor 10)

A photoreceptor 10 was manufactured as in the photoreceptor 1 except that an electron transport compound was not used for forming a surface layer.

(Process for Manufacturing Photoreceptor 11)

A photoreceptor 11 was manufactured as in the photoreceptor 1 except that organic resin fine particles were not used for forming a surface layer.

(Process for Manufacturing Photoreceptor 12)

A photoreceptor 12 was manufactured as in the photoreceptor 1 except that metal oxide fine particles were not used for forming a surface layer.

5, the image-forming unit 10 includes photoreceptor 1, charging unit 2, exposing unit 3, developing unit 4, cleaner (cleaning blade) 6, and a housing. Each developing unit 4 is of a two-component developing type and includes a developing roller 44A (including a magnet roll and a developing sleeve), a limiting blade 44D, supplying/conveyor screws 44B and 44C, and a housing. The external drive can activate the photoreceptors and the developing rollers and apply a predetermined developing bias to the developing rollers.

The evaluation was carried out in the following manner.

(1) The image-forming unit is mounted to the external drive.

(2) The developing unit (developing roller) is connected to a high-voltage line to regulate the developing bias such that the density of the toner on the photoreceptor is 2 g/m$^2$ after the DC development. Toner is added as appropriate to prevent a decrease in toner concentration in the developer.

(3) The image-forming unit was operated for five seconds, and the developing bias was then applied thereto for 0.5 second. The image-forming unit was then rotated for 0.3 second and its operation was stopped.

(4) The level of the residual toner on the photoreceptor was evaluated according to the following criteria.

—Evaluation Criteria—

○: No residual toner

Δ: Streaky residual toner x: Broad residual toner

TABLE 1

| Photoreceptor No. | Organic resin fine particle: Type | Number-average primary particle size (μm) | Additive (parts by mass) | Metal oxide fine particle added/not added | Electron transport compound added/not added |
|---|---|---|---|---|---|
| Photoreceptor 1 | Epostar S (Nippon Shokubai Co., Ltd) | 0.2 | 10 | added | added |
| Photoreceptor 2 | Epostar S (Nippon Shokubai Co., Ltd) | 0.2 | 20 | added | added |
| Photoreceptor 3 | Epostar S (Nippon Shokubai Co., Ltd) | 0.2 | 30 | added | added |
| Photoreceptor 4 | Epostar S6 (Nippon Shokubai Co., Ltd) | 0.5 | 10 | added | added |
| Photoreceptor 5 | Epostar S6 (Nippon Shokubai Co., Ltd) | 0.5 | 20 | added | added |
| Photoreceptor 6 | Epostar S6 (Nippon Shokubai Co., Ltd) | 0.5 | 30 | added | added |
| Photoreceptor 7 | Epostar MS (Nippon Shokubai Co., Ltd) | 2.0 | 10 | added | added |
| Photoreceptor 8 | Epostar MS (Nippon Shokubai Co., Ltd) | 2.0 | 20 | added | added |
| Photoreceptor 9 | Epostar MS (Nippon Shokubai Co., Ltd) | 2.0 | 30 | added | added |
| Photoreceptor 10 | Epostar S (Nippon Shokubai Co., Ltd) | 0.2 | 10 | added | not added |
| Photoreceptor 11 | — | — | — | added | added |
| Photoreceptor 12 | Epostar S (Nippon Shokubai Co., Ltd) | 0.2 | 10 | not added | added |

Examples 1-10 and Comparative Examples 1-2

The photoreceptors 1-12 were evaluated for cleanliness, uniformity of the density of a formed image, and abrasion resistance as below.

(1) Evaluation of Cleanliness

The cleanliness was visually determined after a toner zone on the photoreceptor was wiped with a blade of an external drive.

In particular, the external drive was loaded with an image-forming unit, which is a modification of "BizhubPro C6500" (KONICA MINOLTA). The image-forming unit was almost at the end of its service life. As illustrated in FIG.

(2) Evaluation of Uniformity of the Density of a Formed Image

Figure 7A:
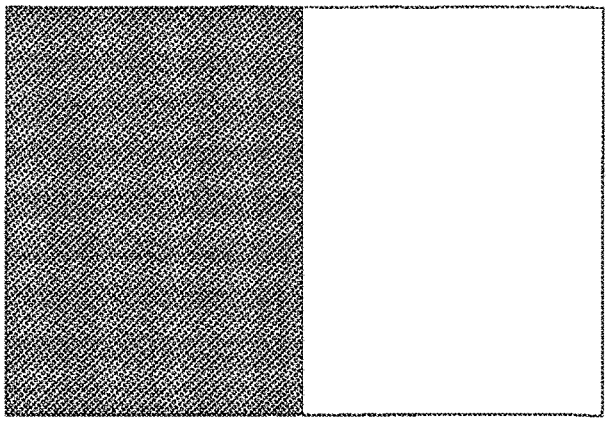
FIG. 7A is a test image used for evaluation in examples.
Figure 7B:
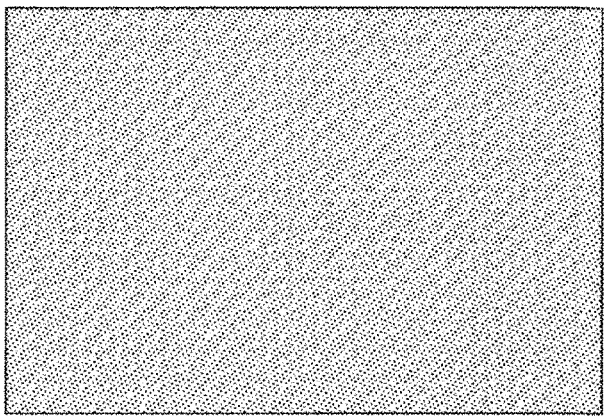
FIG. 7B is a test image used for evaluation in the examples.

A half solid and half white image in FIG. 7A was printed on ten size-A4 sheets with a practical machine. A halftone image in FIG. 7B was then printed to evaluate a difference in image density between a historical solid region and a historical white region according to the following criteria. The image density was measured with a "TD-904" densitometer manufactured by Macbeth.

—Evaluation Criteria—

○: difference<0.02

Δ: 0.02≤difference<0.03 x: 0.03≤difference (3) Evaluation of Abrasion Resistance

Character strings with a coverage rate of about 5% were printed on 100,000 sheets with a practical machine. The abrasion of the surface layer was then measured with "FISCHERSCOPE™ MMS™ PC" manufactured by Fiscer and evaluated according to the following criteria.

◎: abrasion<0.6 μm

○: 0.6 μm≤abrasion<1.2 μm x: 1.2 μm≤abrasion

TABLE 2

| | Photoreceptor No. | Cleanliness | Uniformity of density of formed image | Abrasion resistance |
|---|---|---|---|---|
| Example 1 | Photoreceotpr 1 | ○ | ○ | ○ |
| Example 2 | Photoreceotpr 2 | ○ | ○ | ○ |
| Example 3 | Photoreceotpr 3 | ○ | ○ | ○ |
| Example 4 | Photoreceotpr 4 | ○ | ○ | ○ |
| Example 5 | Photoreceotpr 5 | ○ | ○ | ○ |
| Example 6 | Photoreceotpr 6 | ○ | ○ | ○ |
| Example 7 | Photoreceotpr 7 | ○ | ○ | ○ |
| Example 8 | Photoreceotpr 8 | ○ | ○ | ○ |
| Example 9 | Photoreceotpr 9 | ○ | ○ | ○ |
| Reference Example 1 | Photoreceotpr 10 | ○ | Δ | ○ |
| Comparative Example 1 | Photoreceptor 11 | X | X | ○ |
| Comparative Example 2 | Photoreceptor 12 | ○ | Δ | X |

Example 2

Process for Manufacturing Photoreceptor 21

The same conductive support as in the process for manufacturing photoreceptor 1 was used. "Preparation of intermediate layer", "Preparation of charge generating layer", and "Preparation of charge transport layer" were carried out in the same process as the process for manufacturing photoreceptor 1, to yield an intermediate layer 21, a charge generating layer 21, and a charge transport layer 21.

(Preparation of Surface Layer)

(1) Preparation of Surface-Treated Organic Resin Fine Particles

A mixture of methanol (20 g) and water (2 g) was agitated. Concentrated hydrochloric acid was added to the mixture into a pH of 2 to 3. The exemplary compound (C-5) (2.5 g) was added to the mixture as a silane coupling agent and the mixture was agitated for one hour at room temperature. A dispersion of 10 mass % melamine resin "Epostar S6" having an average particle size of 400 nm (Nippon Shokubai Co., Ltd.) in methanol was added to the mixture, and the mixture was agitated at 40° C. for two hours. The mixture was then neutralized with saturated sodium bicarbonate solution, was filtered, and was dried at 120° C. for two hours to complete surface treatment. The resulting fine particles served as organic resin fine particles 21.

(2) Preparation of Surface Layer

Inorganic fine particles 21 composed of tin oxide having an average particle size of 20 nm (85 parts) and organic resin fine particles 21 (25 parts), a multi-functional radical polymerizable compound composed of the exemplary compound (M1) (100 parts), and solvents composed of 2-butanol (400 parts) and tetrahydrofuran (THF) (40 parts) were mixed in the dark and then dispersed with a sand mill for five hours. A polymerization initiator composed of the exemplary compound (P2) (10 parts) was added, and the mixture was agitated in the dark for dissolution to prepare a coating solution for a surface layer 21. The coating solution for the surface layer 21 was applied to the charge transport layer 21 with a circular slide hopper coater to form a coating film. The coating film was then irradiated with UV rays for 1 min with a metal halide lamp to forma surface layer 21 having a dry thickness of 5.0 μm. Thus, the photoreceptor 21 was prepared. The inorganic fine particles in the surface layer 21 had a number-average primary particle size of 20 nm. The organic resin fine particles in the surface layer 21 had a number-average primary particle size of 400 nm.

(Process for Manufacturing Photoreceptors 22-28)

Photoreceptors 22-28 were manufactured as in the photoreceptor 21 except that the type of the organic resin fine particles for forming a surface layer were as shown in Table 3.

In Table 3, the inorganic fine particles 23, 24, 26, and 27, which are composite fine particles having a core-shell structure, are prepared in the following process.

In Table 3, the organic resin fine particles 22-27 are prepared by the following process. The organic resin fine particles 28 are surface-untreated fine particles of untreated melamine resin "Epostar S6" (Nippon Shokubai Co., Ltd.).

(Preparation of Inorganic Fine Particles 23)

A mixture of pure water (3 L) and 35% hydrochloric acid (0.1 L) was heated to 75° C. In the resulting hydrochloric acid solution, alumina cores having an average particle size of 200 nm (300 g) were suspended. A titanium tetrachloride solution (50 mass % Ti) was then added to the solution during agitation at an amount of 36 g/hr, while sodium hydroxide (10 mass %) was added to the solution at a rate of 360 ml/hr. Slurry containing the resulting particles was subjected to repulping cleaning until its conductivity reached 100 μS/cm or less, then filtered through a Büchner funnel to provide a cake. The cake was dried under vacuum at 150° C. to prepare inorganic fine particles 23 each composed of an alumina core coated with titanium oxide.

(Preparation of Inorganic Fine Particles 24)

Figure 8:
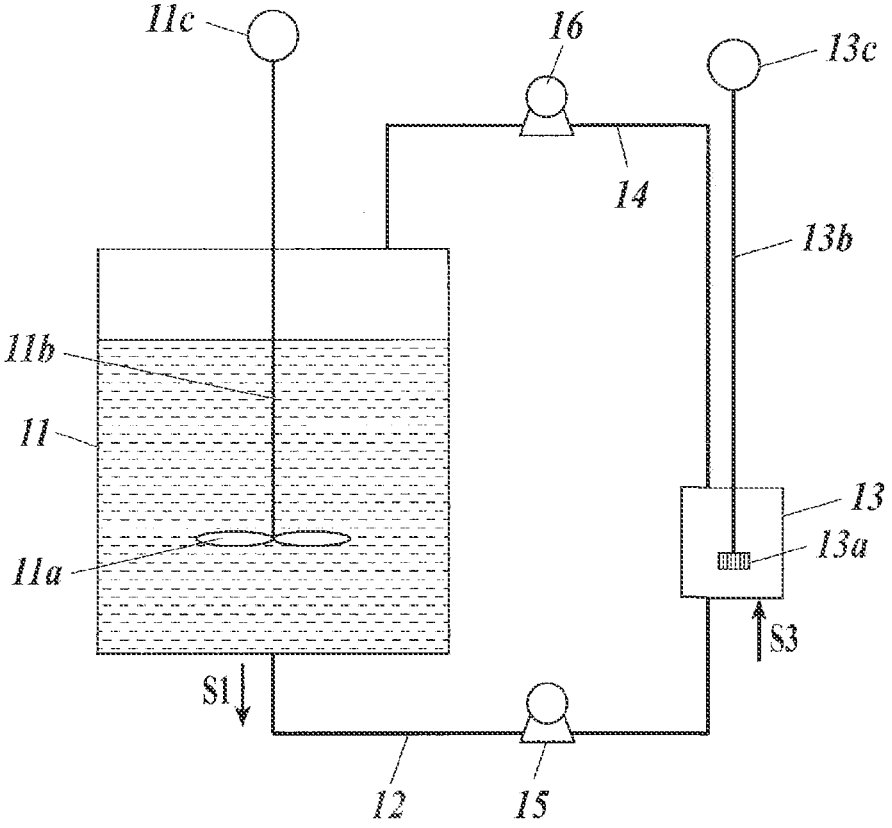
FIG. 8 is a schematic view illustrating an exemplary configuration of a device for manufacturing composite fine particles used in the examples.

A barium sulfate core coated with tin oxide was prepared with the apparatus in FIG. 8 as inorganic fine particles 24.

In specific, pure water (3500 $cm^3$) and then spherical barium sulfate cores (900 g) having an average particle size of 100 nm were introduced into a vessel 11. The mixture was circulated five passes. The flow rate of the slurry flowing out from the vessel 11 was 2280 cm/min. The rotational rate of a powerful dispersing unit 13 was 16000 rpm. The slurry resulting from the circulation was diluted with pure water in a measuring cylinder into a total volume of 9000 $cm^3$. Sodium stannate (1600 g) and a 25N sodium hydroxide solution (2.3 $cm^3$) were introduced thereinto and the mixture was circulated five passes. Thus, a stock solution was prepared. The stock solution was circulated such that it flows out from the vessel 11 at a flow rate (S1) of 200 $cm^3$, while sulfuric acid (20%) was introduced into the powerful dispersing unit 13, which was a homogenizer "magic LAB" (IKA Japan), at a feeding rate (S3) of 9.2 cm/min. The volume of the homogenizer was 20 $cm^3$, and the rotational rate was 16000 rpm. The circulation was continued for 15 min while sulfuric acid was continuously introduced into the homogenizer. The process yielded particles each composed of a barium sulfate core coated with a layer of tin oxide.

Slurry containing the resulting particles was subjected to repulping cleaning until its conductivity reached 600 μS/cm or less, and then filtered with a Büchner funnel to provide a cake. The cake was dried in the atmosphere at 150° C. for 10 hours. The dried cake was pulverized and the resulting particles were subjected to reduction firing under an atmosphere of 1 volume % $H_2/N_2$ at 450° C. for 45 min. The process yielded inorganic fine particles 24 each composed of a barium sulfate core coated with tin oxide.

The apparatus in FIG. 8 includes a circulation pipes (paths) 12 and 14 between the vessel 11 and the powerful dispersing unit 13; pumps 15 and 16 provided to the circulation pipes 12 and 14, respectively; an impeller 11*a*; an impelling member 13*a*; shafts 11*b* and 13*b*; and motors 11*c* and 13*c*.

(Preparation of Inorganic Fine Particles 26)

Inorganic fine particles 26 each composed of a silica core coated with titanium oxide were prepared as in the inorganic fine particles 23 except that silica cores having an average particle size of 250 nm were used instead of the alumina cores.

(Preparation of Inorganic Fine Particles 27)

Inorganic fine particles 27 each composed of an alumina core coated with tin oxide were prepared as in the inorganic fine particles 24 except that alumina cores having an average particle size of 100 nm were used instead of the barium sulfate cores.

(Preparation of Organic Resin Fine Particles 22-27)

Organic resin fine particles 22-27 were prepared as in the surface-treated organic resin particles in the process for manufacturing photoreceptor 21 except that the types of melamine resin and coupling agent were as in Table 3.

evaluation. Examples 21-27 are the evaluation on the photoreceptors 21 to 27, and comparative example 3 is the evaluation on the photoreceptor 28. The light source of the evaluation device "bizhub PRO C6501" was a semiconductor laser having a wavelength of 780 nm.

A durability test involving continuously printing a character string image having an image rate of 6% on the both sides of 300,000 size-A4 sheets fed transversely under a high temperature and humidity environment, in specific, at a temperature of 30° C. and a humidity of 85% to evaluate potential stability, cleanliness, and scratch resistance which are described below. The results are shown in Table 4.

(1) Evaluation of Potential Stability

The potential stability was evaluated based on potential fluctuations at an exposure unit before and after the durability test.

In specific, the initial charge potential was set to 600±50V, and the changes of the potential (ΔV) at the exposure unit were determined before and after the durability test involving 300,000 printing processes. The evaluation was based on the following criteria.

TABLE 3

| | Inorganic fine particle | | | | | Organic resin fine particle | | | |
|---|---|---|---|---|---|---|---|---|---|
| Photoreceptor No. | No. | Composition 1 (*1) | Composition 2 | Number-average primary particle size (nm) | Volume resistivity (Ω cm) | No. | Type | Coupling agent | Number-average primary particle size (nm) |
| 21 | 21 | $SnO_2$ (20 nm) | | 20 | $5.6 \times 10^6$ | 21 | Epostar S6 (*2: 400 nm Nippon Shokubai Co., Ltd) | C-5 | 400 |
| 22 | 22 | $SnO_2$ (50 nm) | | 50 | $3.7 \times 10^5$ | 22 | Epostar S12 (*2: 1000 nm Nippon Shokubai Co., Ltd) | C-4 | 1000 |
| 23 | 23 | $Al_2O_3$ (200 nm) | $TiO_2$ | 200 | $5.3 \times 10^8$ | 23 | Epostar S (*2: 200 nm Nippon Shokubai Co., Ltd) | C-9 | 200 |
| 24 | 24 | $BaSO_4$ (100 nm) | $SnO_2$ | 100 | $8.2 \times 10^1$ | 24 | Epostar S6 (*2: 400 nm Nippon Shokubai Co., Ltd) | C-4 | 400 |
| 25 | 25 | $TiO_2$ (100 nm) | | 100 | $2.9 \times 10^7$ | 25 | Epostar S6 (*2: 400 nm Nippon Shokubai Co., Ltd) | C-9 | 400 |
| 26 | 26 | $SiO_2$ (250 nm) | $TiO_2$ | 250 | $2.1 \times 10^8$ | 26 | Epostar S (*2: 200 nm Nippon Shokubai Co., Ltd) | C-5 | 200 |
| 27 | 27 | $Al_2O_3$ (100 nm) | $SnO_2$ | 100 | $8.5 \times 10^{-3}$ | 27 | Epostar S12 (*2: 1000 nm Nippon Shokubai Co., Ltd) | C-8 | 1000 |
| 28 | 25 | $TiO_2$ (100 nm) | | 100 | $2.9 \times 10^7$ | 28 | Epostar S6 (*2: 400 nm Nippon Shokubai Co., Ltd) | — | 400 |

(*1): inside parentethis is mean particle size

*2: mean particle size

The prepared organic resin fine particles 21 to 28 were evaluated for their aggregation.

In specific, organic resin fine particles 21 to 28 (each 0.2 g) were each added to 4.8 g of 2-butanol dispersion containing 20 mass % of tin oxide, and aggregation was visually observed. The evaluation was conducted based on the following criteria. The results are shown in Table 4.

—Evaluation Criteria—

◎: Not observed (Excellent)

○: Slightly observed (Practically acceptable)

x: Noticeably observed (Impractical)

Example 21-27, Comparative Example 3

Photoreceptors 21 to 28 were each mounted on an evaluation device "bizhub PRO C6501" (available from KONICA MINOLTA, INC.), which has basically the same structure as that of the image-forming apparatus illustrated in FIG. 4, for —Evaluation Criteria—

◎: ΔV<30V (Significantly excellent)

○: 30V≤ΔV<60V (Excellent)

Δ: 60V≤ΔV<100V (Practically acceptable)

x: ΔV≤100V (Impractical)

(2) Evaluation for Cleanliness

Evaluation of cleanliness, which was based on the following criteria, was conducted after the durability test. The criteria are as follows.

—Evaluation Criteria—

◎: No toner passing through blade gap, blade abrasion width<20 μm (Excellent)

○: No toner passing through blade gap, blade abrasion width≥20 μm (Practically acceptable)

x: Toner passing through blade gap (Impractical)

(3) Scratch Resistance

After the durability test, a halftone image was printed on the entire surface of a size-A3 sheet for an evaluation of scratch resistance based on the following criteria.

—Evaluation Criteria—

◎: No noticeable and visually observable scratch on the surface of the photoreceptor, no image defect, caused by the scratch on the photoreceptor, on the halftone image (Excellent)

○: Slight visually observable scratches on the surface of the photoreceptor, no image defect, caused by the scratch on the photoreceptor, on the halftone image (Practically acceptable)

x: Noticeable visually observable scratches on the surface of the photoreceptor, image defects, caused by the scratches on the photoreceptor, on the halftone image (Impractical)

TABLE 4

| | Photoreceptor | Agglomeration | Potential stability ΔV (V) | Potential stability evaluation | Cleanliness | Scratch resistance |
|---|---|---|---|---|---|---|
| Example 21 | 21 | ◎ | 47 | ○ | ◎ | ◎ |
| Example 22 | 22 | ◎ | 45 | ○ | ○ | ◎ |
| Example 23 | 23 | ○ | 91 | Δ | ◎ | ○ |
| Example 24 | 24 | ◎ | 26 | ◎ | ◎ | ◎ |
| Example 25 | 25 | ○ | 53 | ○ | ◎ | ○ |
| Example 26 | 26 | ◎ | 87 | Δ | ○ | ◎ |
| Example 27 | 27 | ○ | 22 | ◎ | ○ | ○ |
| Reference Example 2 | 28 | X | 55 | ○ | X | X |

As shown in Table 4, Examples 21 to 27 of the present invention demonstrate that the organic resin fine particles surface-treated with a coupling agent provide excellent dispersibility, excellent cleanliness while maintaining potential stability, and high scratch resistance.

Comparative example 3 demonstrates that organic resin fine particles which are not surface-treated with a coupling agent provide poor dispersibility, cleanliness, and scratch resistance. A possible cause for the phenomenon should be the presence of aggregation of organic resin fine particles in the surface layer. It is believed that the aggregated particles, which are irregularly distributed in the surface layer, readily desorb from the surface layer by the friction, causing scratches. In addition, it is believed that the scratches on the surface layer leads to a roughened surface, resulting in poor cleanliness.

The electrophotographic photoreceptor according to the invention includes a surface layer composed of a cured resin containing organic resin fine particles composed of a resin containing a structural unit derived from at least one of melamine and benzoguanamine and metal oxide fine particles. The organic resin fine particles have a diameter within a specified range. The photoreceptor can therefore be sufficiently cleaned, and the uneven density of a formed image can be prevented.

The image-forming apparatus according to the invention, which includes the electrophotographic photoreceptor, can achieve an excellent cleaning operation and thus can form high-quality images for a long period. Furthermore, the uneven density of an image can be prevented regardless of uneven application of the lubricant.

The image-forming method according to the invention, which uses the electrophotographic photoreceptor, can achieve an excellent cleaning operation and thus can form high-quality images for a long period. Furthermore, the uneven density of an image can be prevented regardless of uneven application of the lubricant.

The electrophotographic photoreceptor according to the invention includes a surface layer composed of a cured resin containing inorganic fine particles and organic resin fine particles composed of a resin containing a structural unit derived from at least one of melamine and benzoguanamine. At least part of the surface of each inorganic fine particle is composed of metal oxide. The organic resin fine particles are surface-treated with a coupling agent. The photoreceptor can therefore be sufficiently cleaned and has high durability.

The method of producing the electrophotographic photoreceptor according to the invention can prevent the coagulation of the organic resin fine particles and the inorganic fine particles in the coating solution for preparation of a surface layer, and thus can certainly produce the photoreceptor.

The image-forming apparatus according to the invention, which includes the electrophotographic photoreceptor, can form high-quality images for a long period.

The entire disclosure of Japanese Patent Application No. 2013-209063 filed on Oct. 4, 2013 and Japanese Patent Application No. 2013-255808 filed on Dec. 11, 2013 including description, claims, drawings, and abstract are incorporated herein by reference in its entirety.

What is claimed is:

1. An electrophotographic photoreceptor, comprising:

a conductive support;

a photosensitive layer on the conductive support; and a surface layer on the photosensitive layer, wherein the surface layer comprises a cured resin prepared by polymerization of a compound having two or more radically polymerizable functional groups per molecule, the cured resin containing an organic resin fine particle, a metal oxide fine particle, and a charge transportable compound, the organic resin fine particle comprising a resin containing a structural unit derived from at least one of melamine and benzoguanamine, the organic resin fine particle having a number average primary particle size of 0.01 to 3.00 μm, and the charge transportable compound is represented by Formula 1:

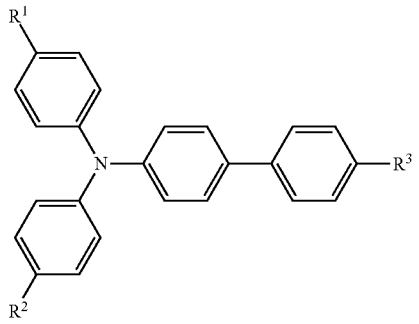

wherein $R^1$ and $R^2$ each independently represent a hydrogen atom or methyl group, and $R^3$ represents a linear or branched alkyl group having one to five carbon atoms.

2. The electrophotographic photoreceptor according to claim 1, wherein the organic resin fine particle comprises a polycondensate of melamine and formaldehyde.

3. The electrophotographic photoreceptor according to claim 1, wherein the organic resin fine particle is contained in an amount of 5 to 40 parts by mass relative to 100 parts by mass of the cured resin.

4. The electrophotographic photoreceptor according to claim 1, wherein the metal oxide fine particle is surface-treated with a surface treating agent comprising a compound having a radically polymerizable functional group.

5. The electrophotographic photoreceptor according to claim 1, wherein the cured resin comprises an acrylic resin.

6. An image-forming apparatus, comprising:

an electrophotographic photoreceptor;

a charging unit to charge the surface of the electrophotographic photoreceptor;

an exposing unit to form an electrostatic latent image on the surface of the electrophotographic photoreceptor;

a developing unit to develop the electrostatic latent image with a developer comprising a toner to form a toner image;

a transferring unit to transfer the toner image onto a transfer medium;

a fixing unit to fix the transferred toner image on the transfer medium;

a cleaning unit to remove residual toner on the electrophotographic photoreceptor; and a lubricant applying mechanism to apply a lubricant on the surface of the electrophotographic photoreceptor, wherein the electrophotographic photoreceptor is the electrophotographic photoreceptor according to claim 1.

7. The image-forming apparatus according to claim 6, wherein the charging unit is of a contact or contactless roller discharging mechanism.

8. A method of forming an image, comprising:

charging a surface of the electrophotographic photoreceptor;

exposing to form an electrostatic latent image on the surface of the electrophotographic photoreceptor;

developing the electrostatic latent image with a developer comprising a toner to form a toner image;

transferring the toner image on a transfer medium;

fixing the transferred toner image on the transfer medium; and cleaning to remove a residual toner on the electrophotographic photoreceptor, wherein the developer further comprises a lubricant, and the electrophotographic photoreceptor is the electrophotographic photoreceptor according to claim 1.

9. The method of forming an image according to claim 8, wherein in the charging, the electrophotographic photoreceptor is charged by a contact or contactless roller discharging mechanism.

10. An electrophotographic photoreceptor, comprising:

a conductive support;

a photosensitive layer on the conductive support; and a surface layer on the photosensitive layer, wherein the surface layer comprises a cured resin prepared by polymerization of a compound having two or more radically polymerizable functional groups per molecule, the cured resin containing an inorganic fine particle and an organic resin fine particle, at least part of the surface of the inorganic fine particle comprising a metal oxide and the organic resin fine particle comprising a resin containing a structural unit derived from at least one of melamine and benzoguanamine, and the organic resin fine particle is surface-treated with a coupling agent.

11. The electrophotographic photoreceptor according to claim 10, wherein the organic resin fine particle has a number average primary particle size of 100 nm to 1500 nm.

12. The electrophotographic photoreceptor according to claim 10, wherein the coupling agent contains a fluorine atom.

13. The electrophotographic photoreceptor according to claim 10, wherein the inorganic fine particle has a number average primary particle size of 10 nm to 300 nm.

14. The electrophotographic photoreceptor according to claim 10, wherein the inorganic fine particle comprises at least one of tin oxide and titanium oxide.

15. The electrophotographic photoreceptor according to claim 10, wherein the inorganic fine particle is a composite fine particle comprising a core and a metal oxide sheath.

16. The electrophotographic photoreceptor according to claim 15, wherein the core comprises at least one of aluminum oxide, barium sulfate, and silicon oxide.

17. The electrophotographic photoreceptor according to claim 15, wherein the sheath comprises at least one of tin oxide and titanium oxide.

18. The electrophotographic photoreceptor according to claim 10, wherein the radically polymerizable functional group is an acryloyl group or methacryloyl group.

19. An image-forming apparatus, comprising:

an electrophotographic photoreceptor;

a charging unit which charges a surface of the electrophotographic photoreceptor;

an exposing unit which forms an electrostatic latent image on the surface of the electrophotographic photoreceptor;

a developing unit which develops the electrostatic latent image with a developer comprising a toner to form a toner image;

a transferring unit which transfers the toner image onto a transfer medium;

a fixing unit which fixes the transferred toner image on the transfer medium; and a cleaning unit which removes residual toner on the electrophotographic photoreceptor, wherein the cleaning unit comprises a blade, and the electrophotographic photoreceptor is the electrophotographic photoreceptor according to claim 10.

* * * * *